US009502011B2

(12) United States Patent
Clarke

(10) Patent No.: US 9,502,011 B2
(45) Date of Patent: Nov. 22, 2016

(54) GUITAR STRING BENDER

(71) Applicant: Timothy Clarke, Georgetown (CA)

(72) Inventor: Timothy Clarke, Georgetown (CA)

( * ) Notice: Subject to any disclaimer, the term of this patent is extended or adjusted under 35 U.S.C. 154(b) by 0 days.

(21) Appl. No.: 15/066,457

(22) Filed: Mar. 10, 2016

(65) Prior Publication Data

US 2016/0267890 A1 Sep. 15, 2016

Related U.S. Application Data

(63) Continuation-in-part of application No. 14/644,812, filed on Mar. 11, 2015, now Pat. No. 9,324,308.

(51) Int. Cl.
*G10D 3/14* (2006.01)

(52) U.S. Cl.
CPC ..... *G10D 3/146* (2013.01)

(58) Field of Classification Search
CPC ..... G10D 3/146
See application file for complete search history.

(56) References Cited

U.S. PATENT DOCUMENTS 2,949,806 A * 8/1960 Turman ..... G10D 3/146 84/297 R
3,479,917 A * 11/1969 Zitnik, Jr. ..... G10D 3/143 84/312 R
3,686,993 A * 8/1972 Fender ..... G10D 3/143 257/720
4,535,670 A * 8/1985 Borisoff ..... G10D 3/143 84/297 R
5,140,884 A * 8/1992 Bowden ..... G10D 3/14 84/297 R
5,323,680 A * 6/1994 Miller ..... G10D 3/14 84/455
5,413,019 A * 5/1995 Blanda, Jr. ..... G10D 3/146 84/298
5,542,330 A * 8/1996 Borisoff ..... G10D 3/143 84/298
7,329,808 B2 * 2/2008 Davis ..... G10D 3/143 84/298
7,696,420 B2 * 4/2010 Thompson ..... G10D 3/146 84/173
9,324,308 B1 * 4/2016 Clarke ..... G10D 3/143
2011/0067549 A1 * 3/2011 Kingsley ..... G10D 1/02 84/312 R
2013/0180378 A1 * 7/2013 Baker ..... G10D 3/146 84/313
2014/0196590 A1 * 7/2014 Glaser, II ..... G10D 3/06 84/453
2014/0224096 A1 * 8/2014 Callison ..... G10D 3/143 84/312 R
2015/0007705 A1 * 1/2015 Lionello ..... G10D 3/143 84/298

* cited by examiner

*Primary Examiner* — Robert W Horn

(57) ABSTRACT

The invention pertains to a string bender device for use with a stringed instrument, particularly with a guitar. The bending device comprises a mount, an activation lever and a spring device coupled therebetween. The string bender further includes an anchoring arrangement to secure the anchor portion of a guitar string to the string bender. When in use the guitar string anchor is attached to the bending device while the free end of the guitar string is wound around a tuning peg of the guitar. The tension of the string is adjusted using the tuning peg until a desired neutral pitch of the string is achieved. The position of the spring at this tension is defined as the neutral position of the string. The activation lever can then be moved in a first direction to deform the spring in a first direction and move the anchor of the guitar string away from the tuning pegs, causing an increase in string tension and thus raising the pitch of the affected string. Alternatively the activation lever can be moved in a second direction to deform the spring in a second direction and move the guitar string anchor towards the tuning pegs, causing a decrease in tension of the affected string and thus a decrease in pitch. The present invention is advantageous in that it can raise or lower the pitch of the affected string. Furthermore the string bender of the present invention uses existing structures on traditional guitars to facilitate mounting of the string bender thereto.

20 Claims, 23 Drawing Sheets

GUITAR STRING BENDER

This application is a continuation in part of application Ser. No. 14/644,812 filed Mar. 11, 2015.

FIELD OF THE INVENTION

The invention pertains to string bending devices for use on stringed instruments. In particular, the string bending device is particularly adapted for use with guitars.

BACKGROUND OF THE INVENTION

Many devices exist in the music industry which allows musicians of stringed instruments, particularly guitars, to mechanically alter the pitch of a string. Such a device allows the artist great flexibility in providing a vibrato effect on a single string of the instrument. It is often used in country music to provide a country twang.

There are some known string benders which currently exist in the marketplace and each design varies greatly in terms of how it is mounted on the guitar and how it is activated during the playing of a guitar. Many of these devices require permanent structural changes to the guitar such as screwing in the device to the guitar body or hollowing out a portion of the rear of the guitar to accommodate the bending device. Additionally, the devices often contain mechanical stop mechanisms to ensure that the guitar string stays in tune when in neutral position.

The mechanical stops are also used to limit the amount by which the pitch of the string being bent can be changed, typically to one or two semitones. Such mechanical stops limit the movement of the string to a single direction, either up or down in pitch. This limits the creative options for the artist. Additionally, the devices are unable to effect the string pitch more than one or two semitones.

The string bending devices of the prior art tend to be relatively complex, requiring many parts and a great deal of space on the guitar body. As such, there are none that enable more than one guitar string to have a bending device mounted thereon. Again, this limits the creative options for the artist as only select strings can be bent.

There exists a need for a guitar string bender which can allow for the bending of the string both up or down in pitch, small in size and simple in design, thus allowing for multi string benders to be mounted on a guitar at one time.

There is also a need for a pitch-bender to have a greater range than one or two semitones.

SUMMARY OF THE INVENTION

In a first aspect of the invention, the string bender for use with a guitar instrument comprises a mount to couple the string bender to the stringed instrument, a spring device coupled between the mount and an activation lever and an anchoring arrangement to secure an anchor portion of an instrument string having a string portion and an anchor portion. The anchoring arrangement cooperates with the spring device such that when the instrument string is tensioned to achieve a desired neutral pitch, the spring device is in a neutral position. The spring device is deformable such that by moving the activation lever in a first direction, the spring device is deformed from the neutral position in a first direction and the anchor portion of the string is moved to create increased tension of the instrument string, which raises the pitch produced by said instrument string. The spring device is deformed in a second direction by moving the activation lever of the string bender in a second direction. This causes the anchor portion of the instrument string to move in such a way that the tension on the instrument string is decreased, lowering the pitch produced by the instrument string. The anchoring arrangement is a string aperture sized to allow the string portion of the guitar string to pass through while preventing the passage of the anchor portion to secure the guitar string to the string bender.

In yet a further aspect of the invention, the string bender is adapted to be coupled to a guitar having a tailpiece and the mounting arrangement includes a mounting plate having a first face adjacent a first surface of the tailpiece and a second face adjacent the spring device. The mounting arrangement is arranged to facilitate coupling between the tailpiece, mounting plate and spring device to couple the spring device to the guitar.

In yet a further aspect of the invention, the mounting plate includes a hole and the spring device includes a hole; and wherein the hole in the mounting plate aligns with a string channel in the tailpiece of a guitar and the hole in the spring device and the mounting arrangement is adapted to facilitate coupling said string channel, said hole in said mounting plate and said hole in said spring device to couple said spring bender to said guitar.

In yet a further aspect of the invention, the spring device is U-shaped having a first leg and a second leg. The hole in the spring device is located in said first leg of said U-shaped spring device.

In yet a further aspect of the invention, the hole in the mounting plate is elongated to allow for coupling of the string bender relative to various tailpiece designs.

In yet a further aspect of the invention, the mounting plate includes at least two flanged sides.

In yet a further aspect of the invention, the spring device includes an elongated second leg for attachment of the activation lever to the spring device.

In yet a further aspect of the invention, the elongated second leg includes a cutout to engage a protrusion on the underside of the activation lever to prevent twisting of the activation lever relative to the spring device.

In yet a further aspect of the invention, the string aperture is provided in the second leg of said spring device.

In yet a further aspect of the invention, the first and second leg of the spring device include at least 2 flanged edges In another aspect of the invention, the mounting arrangement is adapted to be coupled to a guitar having a bridge plate assembly and a channel extending through the guitar body. The mounting arrangement couples a mounting plate of the string bender to the guitar. The mounting plate has a first end and a second end. The first end is coupled to a spring device and said second end is coupled to a bridge device.

In yet a further aspect of the invention, the bridge device has an opening for the string to pass through and the anchoring arrangement is positioned above and rearwardly of the opening.

In yet a further aspect of the invention, the spring device, the mounting plate and the bridge devices are monolithically formed.

In yet a further aspect of the invention, the spring device is generally u-shaped having a first leg and a second leg and wherein the second leg is adapted to receive the activation lever.

In yet a further aspect of the invention, the second leg includes a cutout to engage a protrusion on the underside of the activation lever to prevent twisting of the activation lever relative to the spring device.

In yet a further aspect of the invention, the activation lever is monolithically formed with said spring device.

In yet a further aspect of the invention, the mounting plate includes at least 2 flanged edges.

In yet a further aspect of the invention, the mounting plate includes a hole to facilitate coupling of said mounting plate with said mounting arrangement.

In yet a further aspect of the invention, the hole in the mounting plate is elongated to provide forward and back adjustment of the string bender relative to the bridge plate.

In yet a further aspect of the invention, the mounting plate includes a vertical height adjustment assembly to adjust the height of the bride device from the bridge plate.

IN THE FIGURES

Preferred embodiments of the present invention are illustrated in the attached drawings in which.

DETAILED DESCRIPTION

Figure 1:
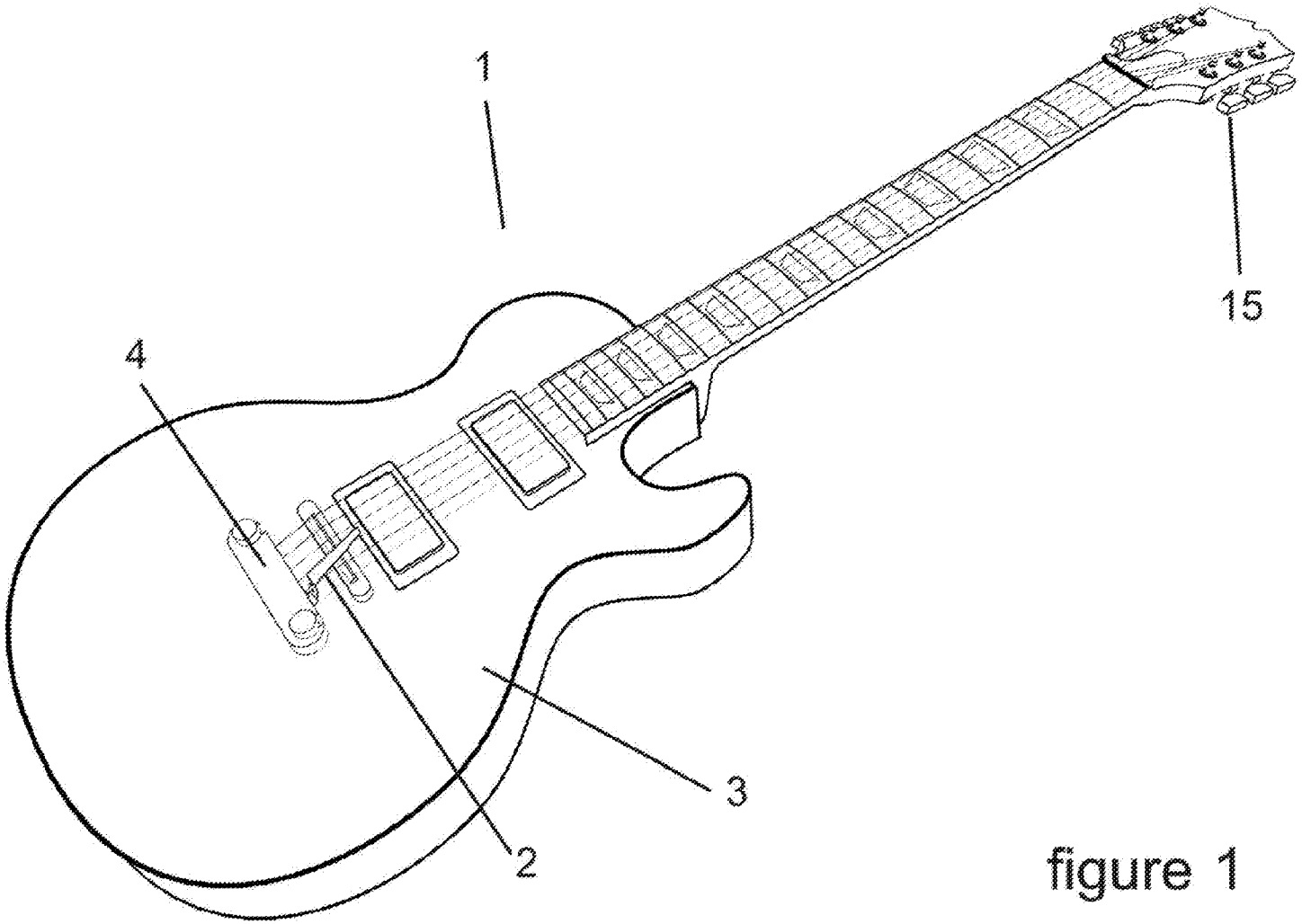
FIG. 1 shows one embodiment of the guitar string bender mounted on a guitar with a tailpiece.
Figure 2:
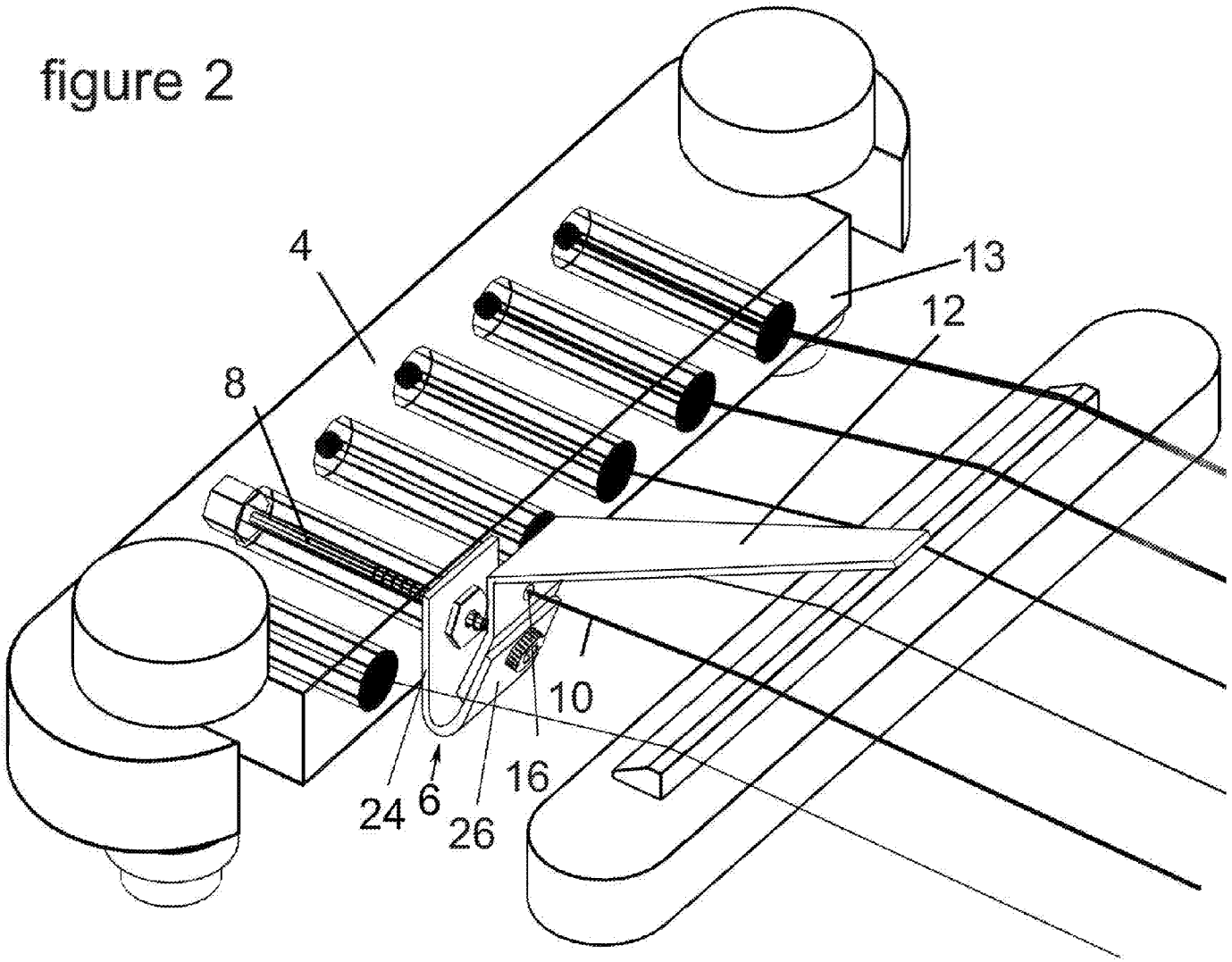
FIG. 2 shows a first embodiment of the guitar string bender mounted on a tailpiece.

The invention pertains to a guitar string bender which allows the pitch of the string to be raised and lowered, is easy to mount, and can be used in combination with a vibrato arm. The string bender of the present invention does not require structural changes to the instrument, which is advantageous in that many guitars lose value of the instrument if they are altered. FIGS. 1 and 2 show the guitar string bending apparatus 2 mounted on a tailpiece 4 of a guitar 1. In this particular embodiment the string bender 2 comprises a spring 6 mounted to the tailpiece 4 using a tailpiece attachment bolt 8. The affected string 10 is anchored to the spring 6 via a hole 16 in the handle 12 which is coupled to the spring 6.

Figure 3:
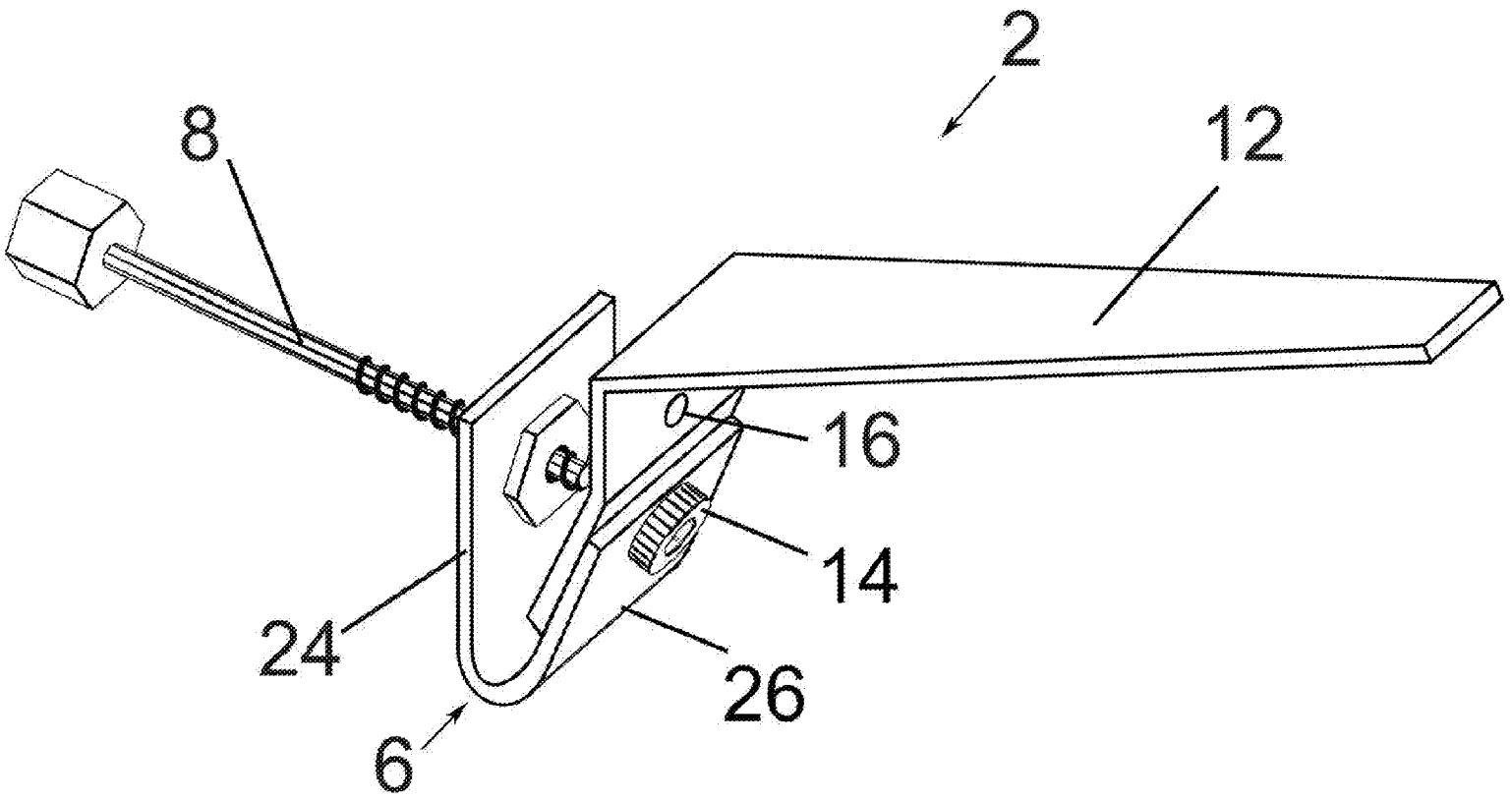
FIG. 3 shows a first embodiment of the guitar string bender when it is not mounted to a guitar.

As shown in FIG. 3, the guitar string bender is of a simple construction. The string bender comprises a mounting bolt 8 which can be fed through the tailpiece of certain guitars, having a tailpiece with channels therethrough for attaching strings. One such example is the Gibson Les Paul guitar.

A mounting bolt 8 is used to couple the spring 6 of the string bender 2 to the tailpiece of a guitar. A U-shaped spring 6 could take different forms, however, in the preferred embodiment shown in the figures, the spring is generally U-shaped. The U-shaped spring has a first leg 24 having a hole to receive a mounting bolt 8. The first leg 24 is configured to lay flat, adjacent the inner wall 13 of the tailpiece 4. This preferred embodiment helps to conserve the space occupied by the string bender 2, making the string bender less obtrusive to the player. The U-shaped spring 6 further compromises a second leg 26 integrally connected to the first leg 24. The second leg 26 is equipped to facilitate the coupling of a handle 12 and guitar string 10 thereto. The handle 12 is coupled to the spring 6 and is used to activate the string bender 2. In this particular example the handle 12 is mounted to the U-shaped spring 6 via a handle mounting screw 14, however it can be appreciated that any suitable coupling means could be used or the handle 12 could be formed continuously and/or monolythically with the U-shaped spring 6.

Figure 4:
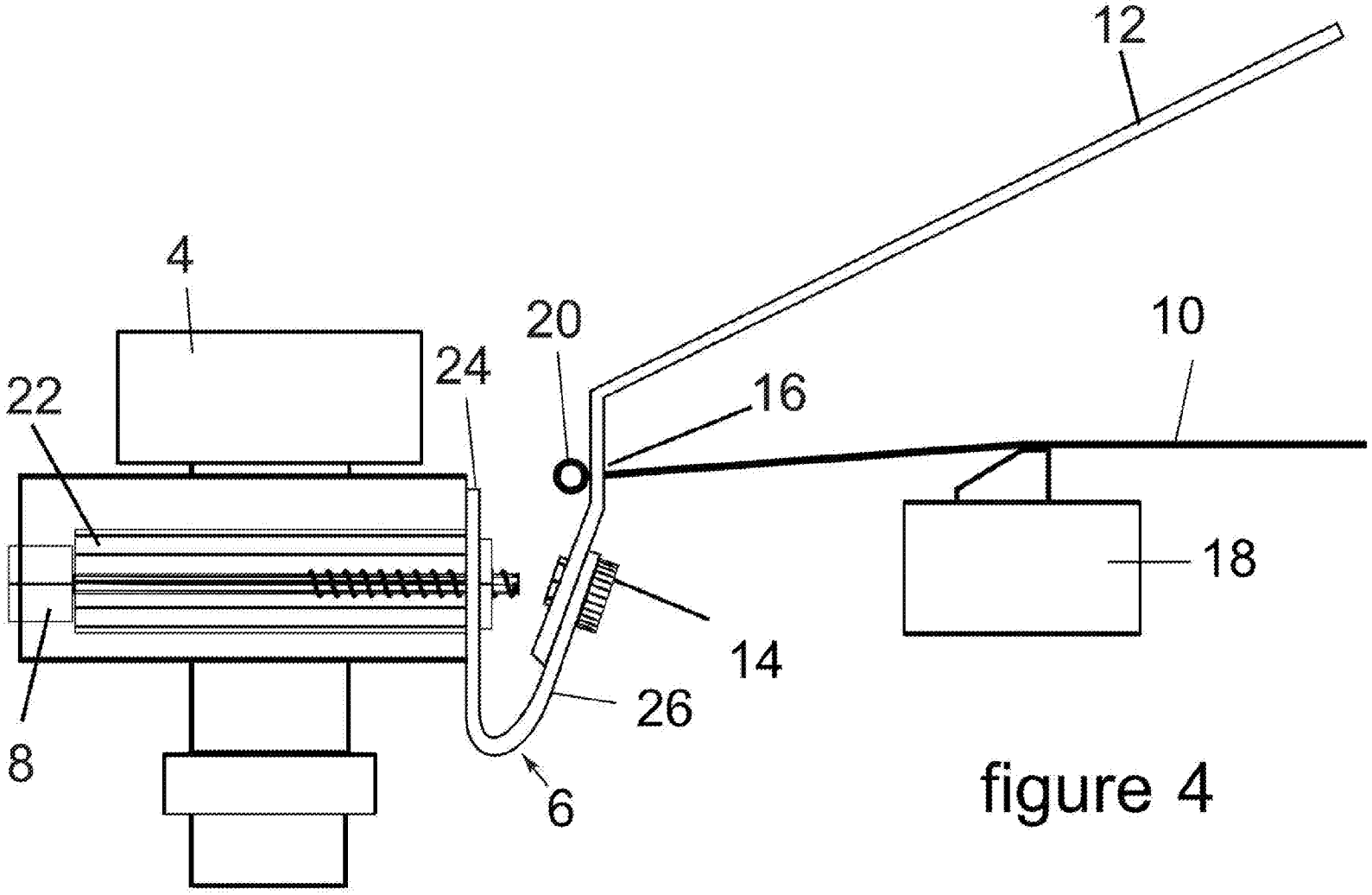
FIG. 4 shows a side view of the first embodiment of the guitar string bender mounted to a tailpiece.

FIG. 4 shows an example of one embodiment of the string bender attached to the tailpiece of a guitar. The tailpiece 4 has a channel 22 which can accommodate the body of the mounting bolt 8 of the string bender. The mounting bolt 8 is sized such that the body of the mounting bolt 8 passes through the string channel 22 of the tailpiece 4 while the head of the mounting bolt abuts the surface around the channel and cannot pass through. The body of the mounting bolt also passes through an aperture in the U-shaped spring 6. The U-shaped spring 6 abuts the surface of the tailpiece opposite the surface contacted by the head of the mounting bolt. A nut is used to secure the U-shaped spring 6 to the mounting bolt 8. This secures the U-shaped spring 6 to the tailpiece 4.

Traditional guitar strings have an anchor on one end thereof and no attachment on the other end. When a user is mounting a string 10 to a guitar equipped with a string bender 2, they would pass the attachment free end of the string 10 through a hole 16 in the handle until the anchor 20 was directly adjacent the handle. Alternatively the hole 16 could be in the second leg 26 of the U-shaped spring 6. The string 10 is then positioned over a bridge 18 and connected to a tuning peg (shown in FIG. 1) at the opposite end of the guitar 1. The string pitch can then be adjusted to a pitch acceptable to the player by turning the turning peg 15 which tightens or loosens the string.

The U-shaped spring 6 is made of a material which has sufficient stiffness to maintain its position and shape when a guitar string is under tension and properly tuned. One example of a suitable material is spring metals.

The string bender can be activated by either lifting the handle 12 away from the body of the guitar 1 or by depressing the handle 12 towards body 3 of the guitar 1. The lifting of the handle compresses the U-shaped spring 6. In the particular embodiment, shown in FIGS. 1 through 4 the spring is U-shaped and lifting the handle 12 causes the second leg 26 to be tilted toward the first leg 24. Since the guitar string 10 is connected via the handle to the spring, this upward and rearward movement of the handle 12 causes the guitar string tension to increase and thus raises the pitch of the string 10.

In contrast, when the handle 12 is depressed toward the body 3 of the guitar 1, the second leg 26 of the spring 6 is tilted away from the first leg 24 of the spring 6. Since the string 10 is anchored to the handle, which is connected to the spring, this depression causes the tension of the spring to decrease and thus lowers the pitch of the string 10.

Depending on the stiffness of the material used to make the spring, the range of variation in the pitch that is possible could be changed. Additionally the material changes the feel of string bender to the artist as the amount of pressure needed to activate the string bender is varied by the material properties. By using spring metal as the material a range of up to 5 semitones in either direction from the neutral position may be achieved, with the preferred design having a range of 3 semitones up and 5 semitones down. Changes in the variation of pitch can also be achieved by adjusting the size or shape of the spring or by changing the location of the string hole relative to the spring.

The concept of using a spring device to maintain a neutral position of a guitar string and having a handle attached thereto to change the pitch of the guitar string can be applied to various designs of guitars.

Figure 14:
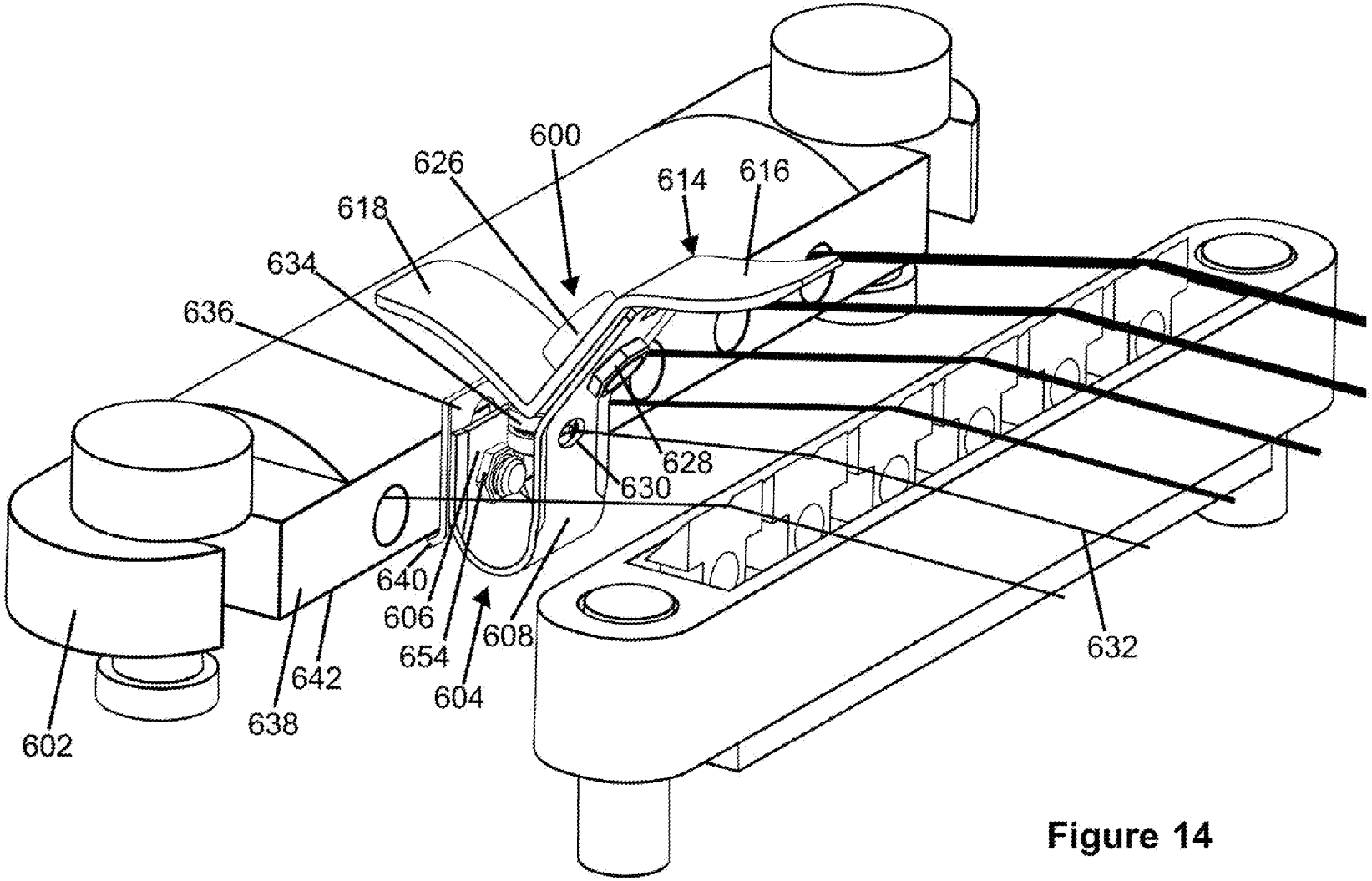
FIG. 14 shows an alternative embodiment of the guitar string bender mounted to the tailpiece of the guitar.

FIG. 14 shows an alternative design for a guitar string bender 600 mounted to a tailpiece 602. As shown in the exploded view of FIG. 15, this alternative design comprises a u-shaped spring 604 having a first leg 606 and a second leg 608. Although the preferred shape of the spring is u-shaped other configurations are possible. First leg 606 and second leg 608 are connected by a bottom portion 610 which is preferably curved to define the shape of a u. This u-shaped spring 604 further includes an extension arm 612. An activation handle 614 is designed to be coupled to the extension arm 612 of the u-shaped spring 604. The activation handle 614 can take several shapes, however, in the preferred embodiment, it has a generally z-shaped structure having a first activation lever 616 extending towards the tuning pegs of the guitar 601 and a second activation lever 618 extending towards the tailpiece of the guitar 601. The orientation of this is shown on a guitar in FIG. 16.

The first activation lever 616 and second activation lever 618 are connected by a mounting portion 620. The mounting portion 620 in the preferred embodiment includes a hole 622 which is designed to align with a hole 624 in the extension arm 612 of the u-shaped spring 604. A bolt 626 and corresponding nut 628 can be fed through hole 622 and 624 to couple the activation handle 614 to the u shaped spring 604. Although permanent coupling mechanisms could be used, the preferred embodiment shown allows the activation handle to be removed from the u-shaped spring. Such a feature may be desirable should users prefer different styles of actuation handle 614 which could be sold as a separate accessary to the remainder of the string bender. Any type of suitable coupling between the activation handle 614 and the extension arm 612 could be used. Alternatively, to reduce manufacturing costs, the actuation handle could include only a single activation lever and could be formed as a single piece with the u-shaped spring 604.

Figure 17:
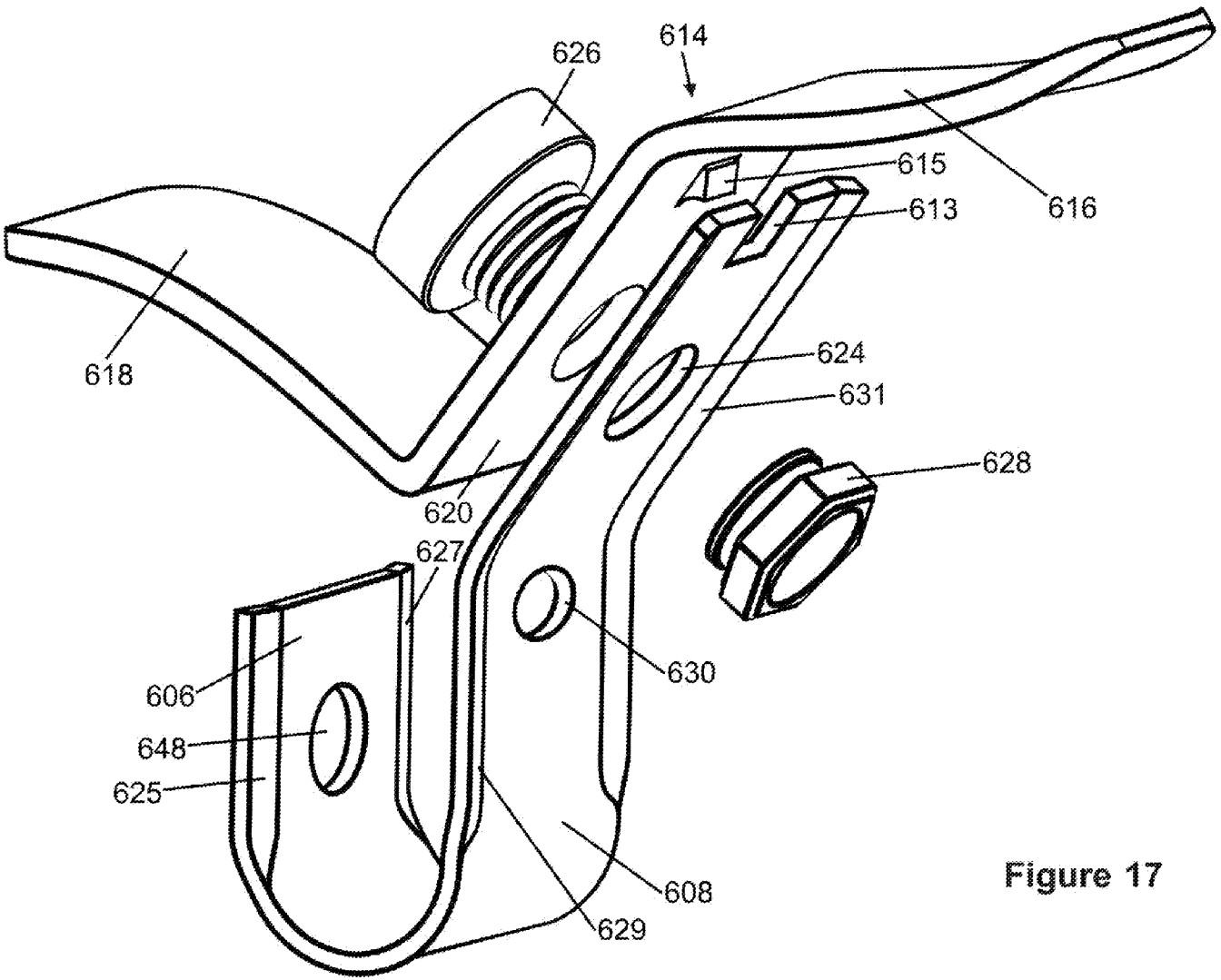
FIG. 17 is a perspective view of the u-shaped spring and activation lever assembly for the alternative embodiment of a guitar string bender to be mounted to the tailpiece of a guitar.

As shown in FIG. 17, the extension arm 612 includes a cut out 613 at the end thereof. This cut out 613 is sized to receive protrusion 615 on the underside of the mounting portion 620 activation handle 614. The engagement of the protrusion 615 in the cutout 613 prevents twisting of the activation handle 614 relative to the extension arm 612. Although the embodiment in the figures shows the cut out along one edge of the extension arm it can also take the form of a hole or indent within the body of the extension arm.

Referring back to FIG. 14, the second leg 608 of u-shaped spring 604 includes a hole 630 through which a guitar string 632 is fed. The guitar string 632 includes an anchor 634, which when the guitar string is pulled tight abuts the first leg 608 of the u-shaped spring 604. The opposite end of string 632 is secured to and tightened by tuning peg 617 (shown in FIG. 16) until the desired pitch of the string is reached.

Figure 15:
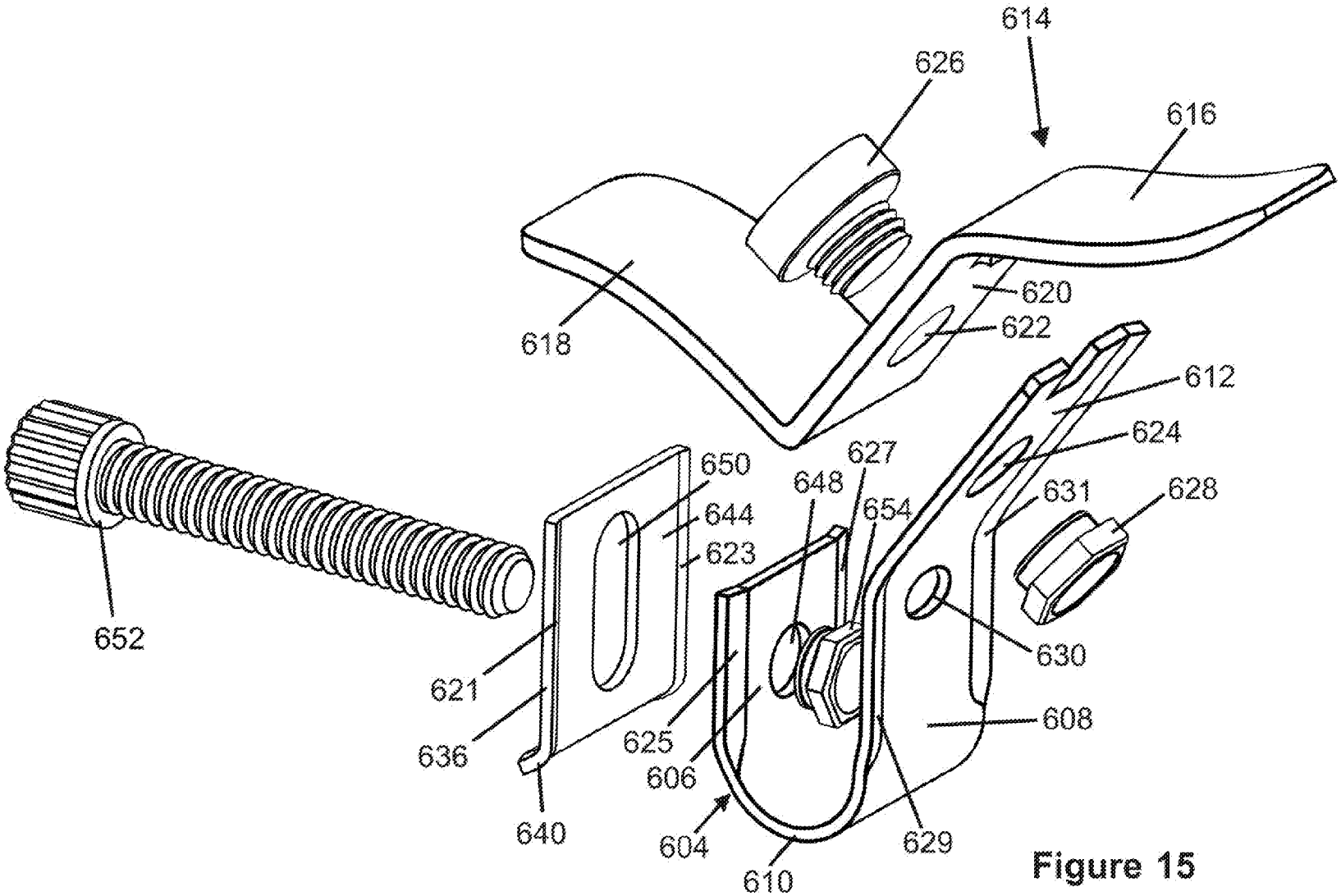
FIG. 15 is an exploded view of an alternative design for a guitar string bender to be mounted to a tailpiece of a guitar.
Figure 16:
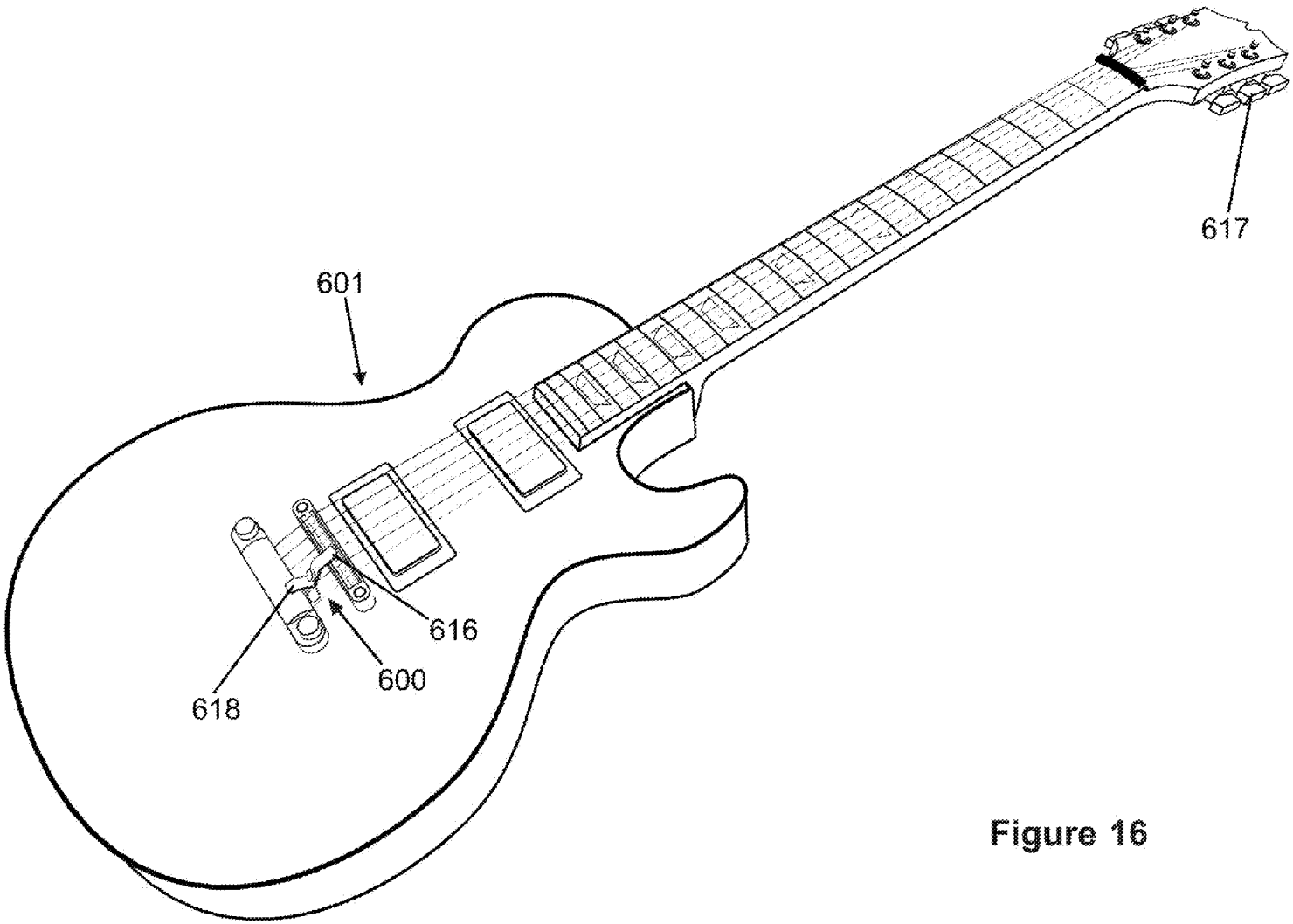
FIG. 16 shows the alternative design for the guitar string bender mounted to a guitar having a tailpiece.

This design further includes a mounting plate 636. As shown in FIG. 14, the mounting plate 636 is secured such that a first surface is adjacent the leading vertical edge 638 of tailpiece 602. As shown in FIG. 15, the mounting plate 636 includes an outwardly turned lower edge 640 to engage the bottom edge 642 of the tailpiece. Once the guitar string bender is securely coupled to the tailpiece, the engagement of the outwardly turned lower edge 640 with the bottom edge 642 of the tailpiece 602 prevents twisting of the mounting plate 636 relative to the tailpiece 602. The second surface 644 of the mounting plate 636 abuts the first leg 606 of the u-shaped spring 604. The first leg 606 of the u-shaped spring 604, includes a hole 648 which generally aligns with slot 650 of the mounting plate 636.

Since different guitars have string channels at slightly different heights, slot 650 of mounting plate 636 is preferably generally oval in shape which allows for variation in the location of the string channel on different guitars with a single string bender design. The mounting plate and u-shaped spring are coupled to the tailpiece 602 by a mounting bolt 652. Mounting bolt 652 passes through the string channel of the tailpiece 602, through the slot 650 of the mounting plate 636 and through hole 648 of the first leg 606 of the u-shaped spring 604. A nut 654 is then used to compress the tailpiece, mounting plate and first leg of the u-shaped spring 604 such that they remain in a stable fictional engagement with each other. Any other suitable mounting arrangement could be used to couple the mounting plate 636 and u-shaped spring 604 to the tailpiece 602.

As shown in FIG. 15, the mounting plate preferably includes two inwardly turned flanged edges 621 and 623 to provide additional stiffness. The width of the mounting plate 636 is set such that the inwardly turned flanged edges 621 and 623, engage the edges of the first leg 606. This prevents twisting of the u-shaped spring 604 relative to the mounting plate 636 and tailpiece 602.

The first leg 606 of u-shaped spring 604 can also be provided with outwardly directed flanges 625 and 627 along the edges thereof for additional stiffness. Furthermore, the second leg 608 and extension arm 612 can also be provided with flanges 629 and 631 along the edges for stiffness.

The activation handle 614 includes the first lever 616 and second lever 618. The opposing directions of the lever arms allows for an artist to fully explore their personal style when it comes to use of a string bender and allows for two methods to change the pitch of the affected string. The downward movement of the first lever 616 or the upward motion of the second lever 618 will move the first leg of the 608 of the u-shaped spring 604 towards the tuning pegs and will lessen the tension in the string 632. This will lower the pitch caused by the string. The raising of the first activation lever 616 or the lowering of the second lever 618 will cause the first leg 608 to move closer to the tailpiece thus tightening the tension of the string 632 and raising the pitch.

FIGS. 6 through 9 show another embodiment in which a spring based string bender 114 is applied to a bridge plate apparatus 115 as opposed to a tailpiece. An example of a guitar with this particular arrangement is the Fender Telecaster.

Figure 5:
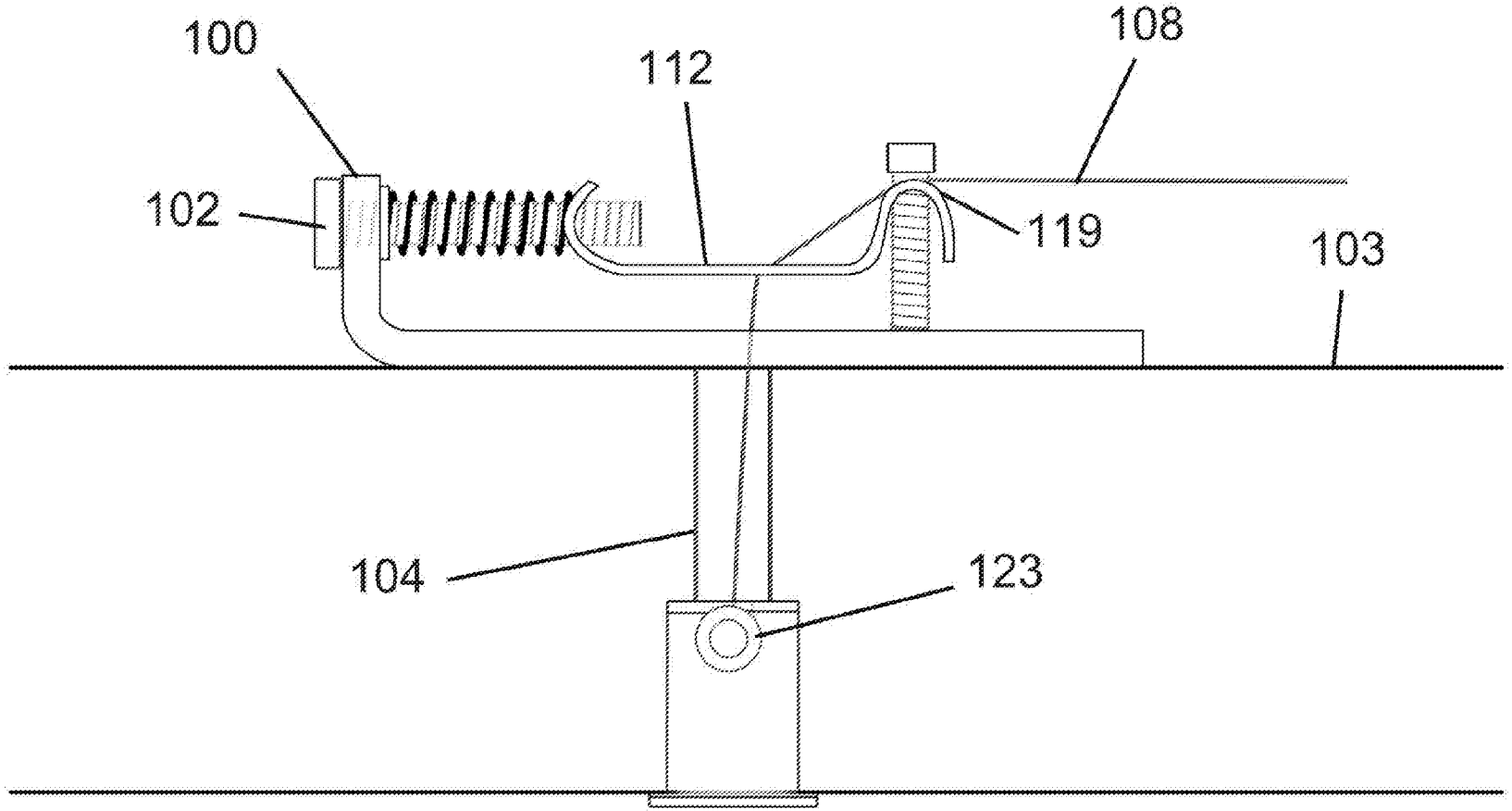
FIG. 5 shows the traditional set up of a bridge plate assembly.

FIG. 5 shows the traditional arrangement of a guitar having a bridge plate 100. The bridge plate 100 is mounted on the body 103 of the guitar and has a bridging device 112 disposed thereon. The bridging device 112 is coupled to the bridge plate 100 by an intonation adjustment bolt 102. The intonation adjustment bolt 102 can be adjusted to pull the bridging device 112 forward and back relative to the guitar body 103. When in use, a guitar string 108 is fed through from the back of the guitar through a hole 104 in the guitar body 103 and the anchor 123 of the guitar string 10 rests against the rim of the hole 104, through which it cannot pass. The string is then directed through an opening in the bridging device 112, over the ridge 119 of the bridging device 112, and is secured at the far end of the guitar using a tuning pin.

Figure 6:
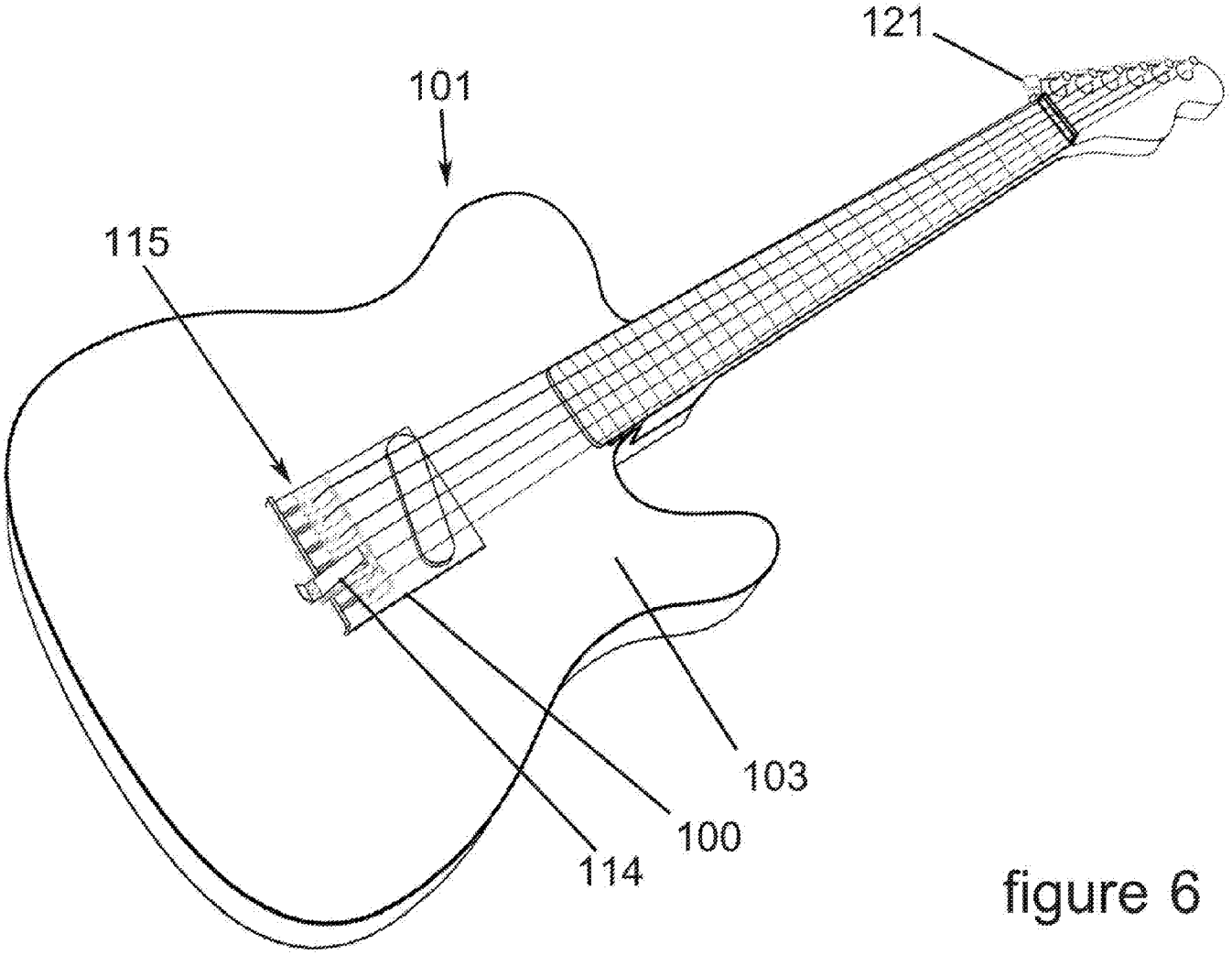
FIG. 6 shows a second embodiment of the guitar string bender mounted to a guitar having a bridge plate assembly.
Figure 7:
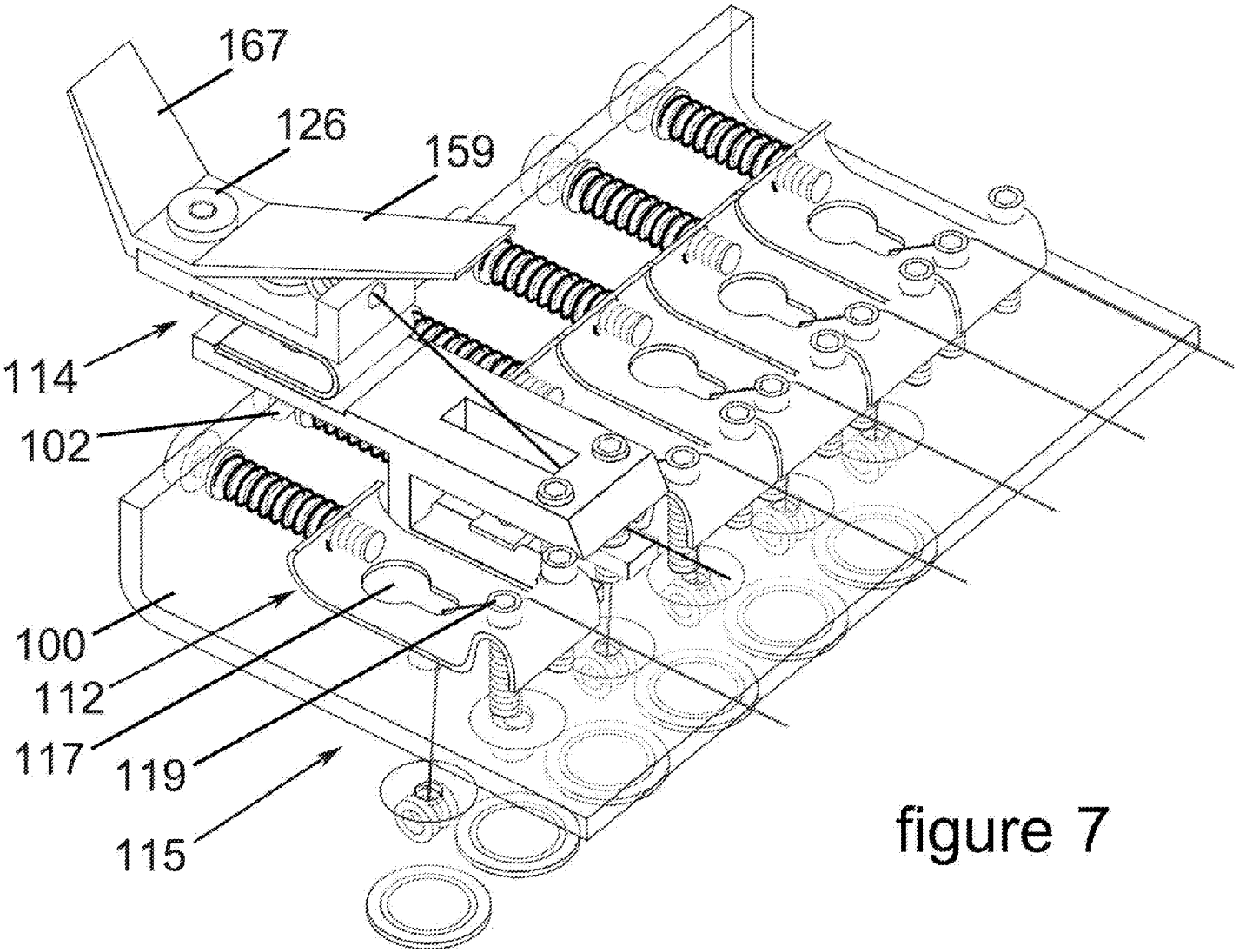
FIG. 7 shows a perspective view of the second embodiment of the guitar string bender mounted to a bridge plate assembly.
Figure 8:
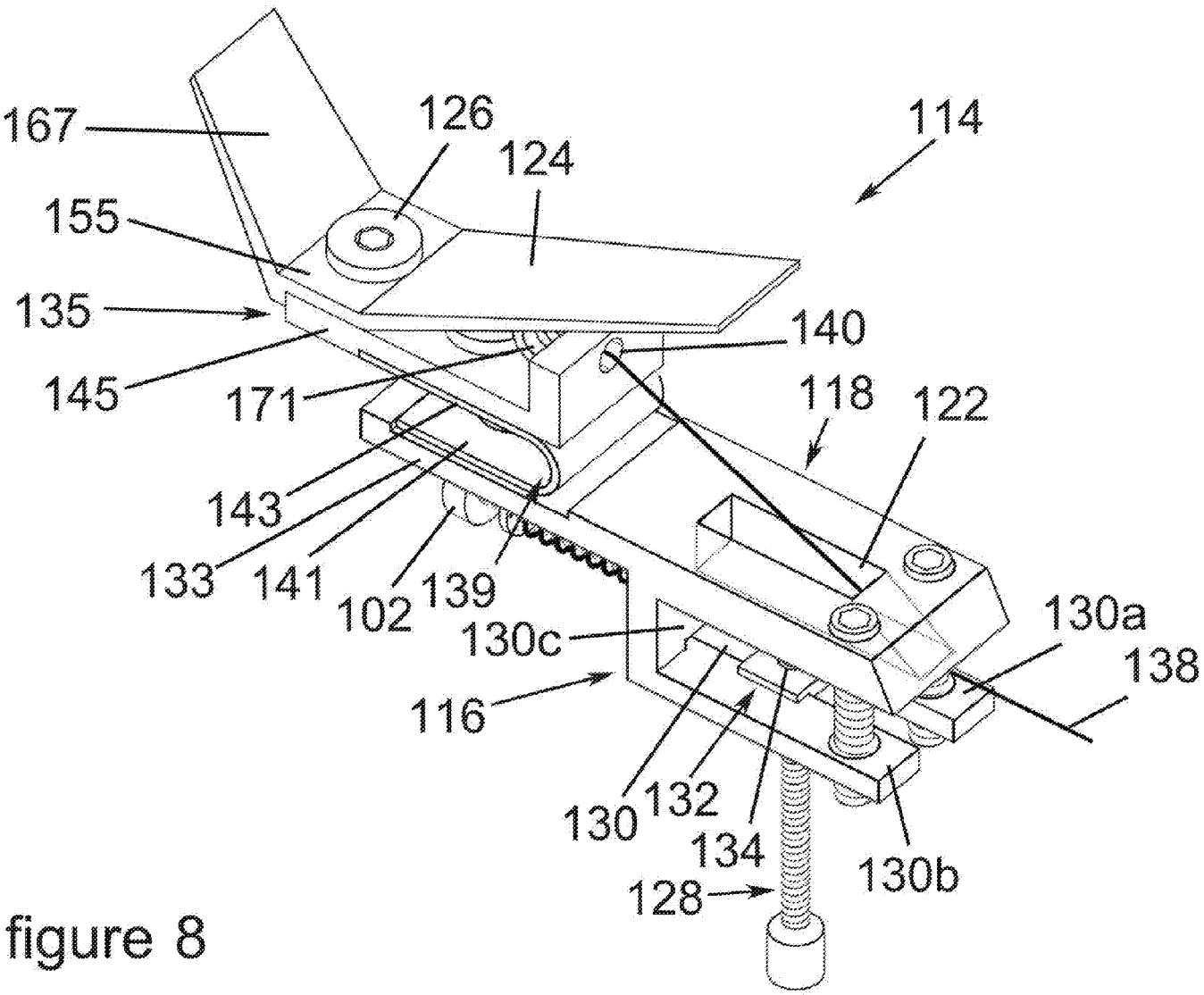
FIG. 8 shows a perspective view of the second embodiment of the guitar string bender in assembled form.
Figure 9:
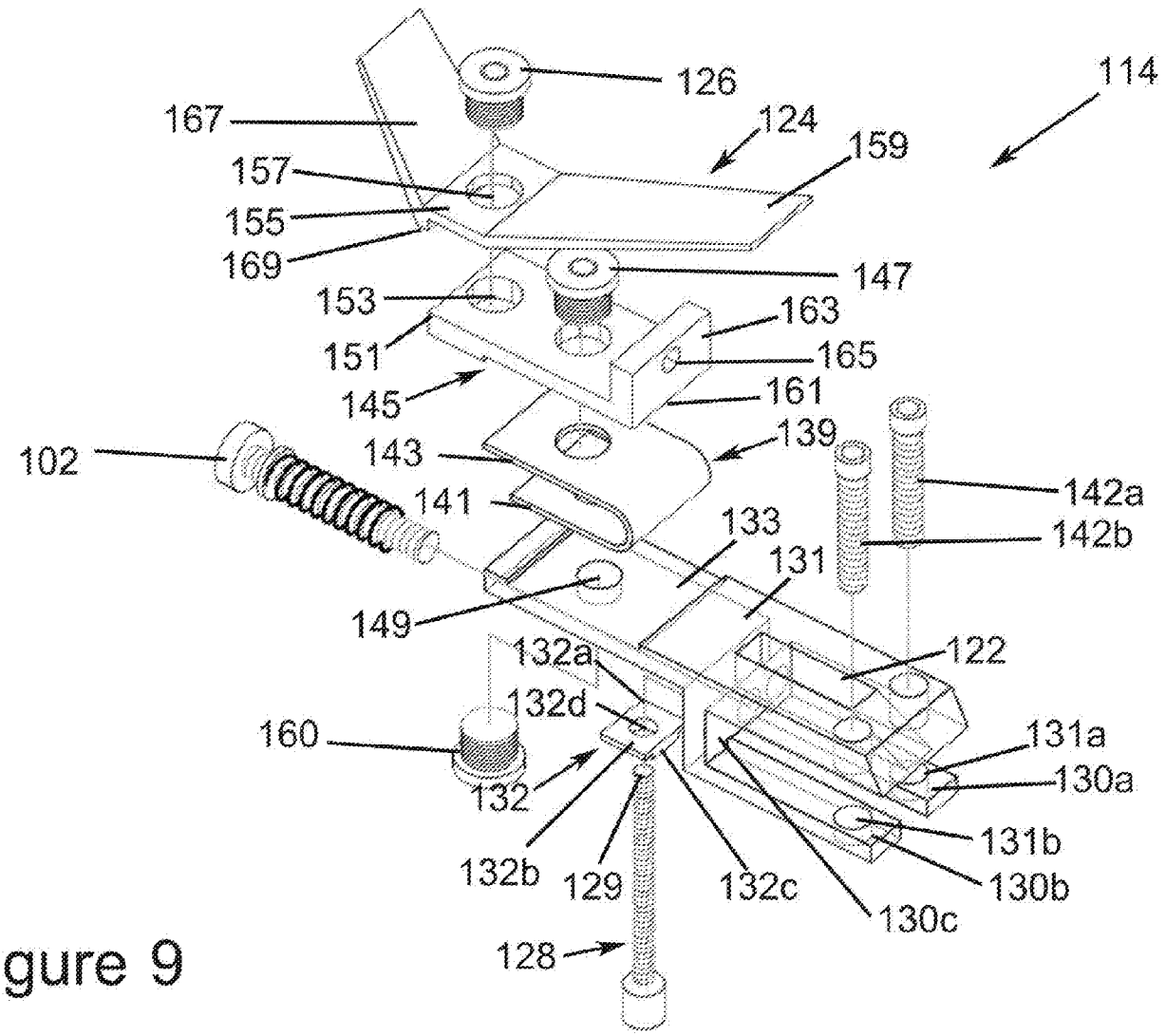
FIG. 9 shows a perspective exploded view of the second embodiment of the guitar string bender.
Figure 10:
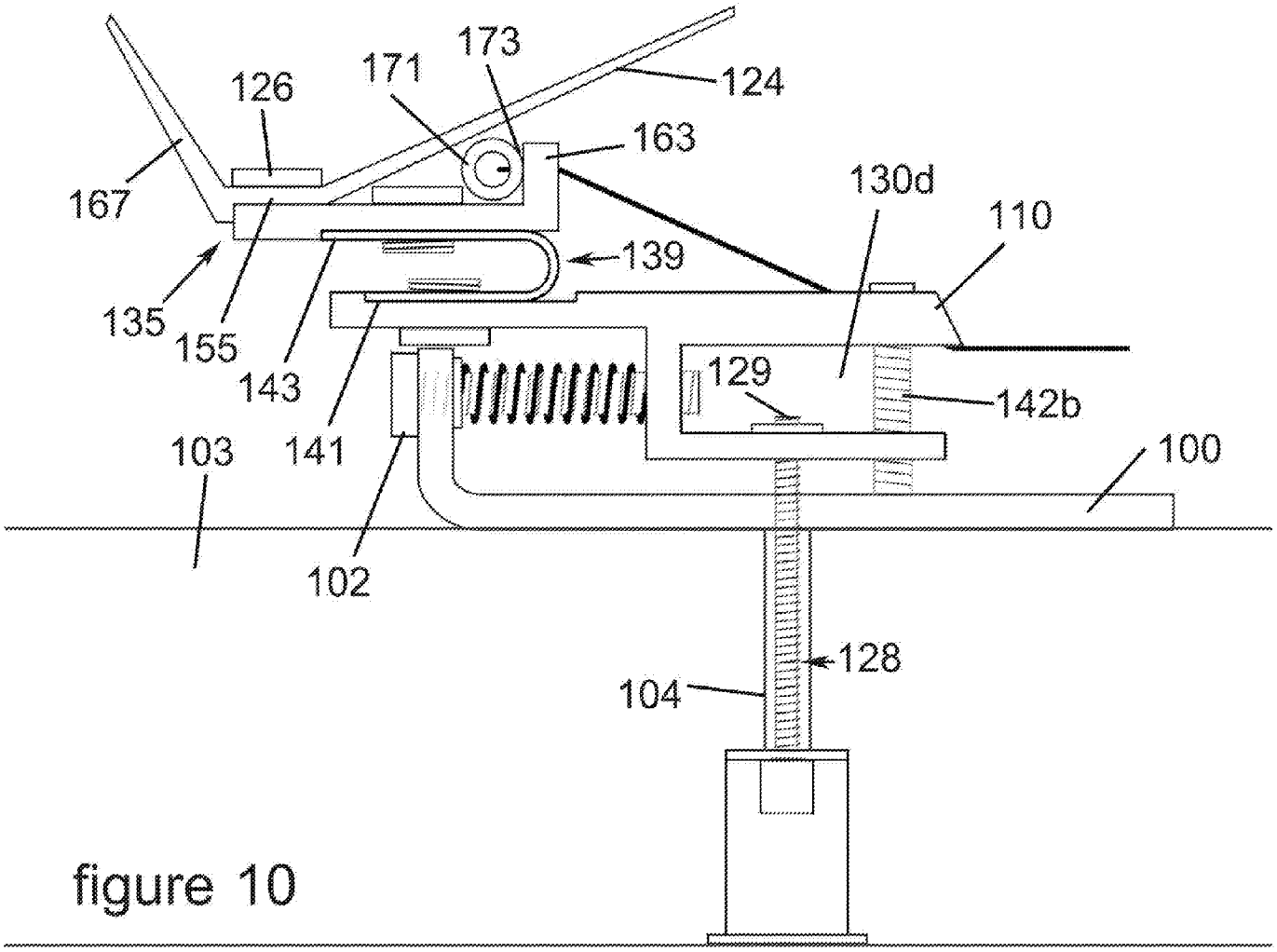
FIG. 10 shows a side elevation view of the guitar string bender mounted to a bridge plate assembly.

The string bender 114 for this particular style of guitar is shown mounted to a guitar in FIGS. 6, 7 and 10 and independently in FIGS. 8 and 9. The bending device 114 is mounted in place of a traditional bridging device. The string bender 114 comprises a mounting block 116 for mounting to the bridge plate 100. The mounting block 116 is fitted with a channel 130 formed by a first arm 130*a* and a second arm 130*b* coupled together by an upwardly extending connecting wall 130*c*.

To mount the string bender 114 to a guitar, a mounting screw 128 is fed from the back of the guitar body 103 through the bridge plate 100 and into the channel 130 (as shown in FIG. 10). The top portion 129 of the mounting screw 128 is coupled to a T-shaped nut 132. The T-shaped nut 132 (shown in FIG. 9) is shaped to have a first arm 132*a* and a second arm 132*b* which, when the string bender is in use, contact the top surfaces of arms 130*a* and 130*b* respectively. The middle portion 132*c* of the T-shaped nut have a greater thickness than the arms 132*a* and 132*b* and a width that generally corresponds to the width of the channel 130. The middle portion 132*c* of the T-shaped nut 132 is provided with a threaded hole 132*d* to receive and engage with the mounting screw 128. As the mounting screw 128 is tightened from the back of the guitar 101, the T-shaped nut 132 is pulled down the mounting screw 128 and compresses the first arm 130*a* and second arm 132*b* between arms 132*a* and 132*b* respectively and the bridge plate 100, thus securing the mounting block 116 to the bridge plate apparatus 115.

The upwardly extending wall 130*c* includes a threaded hole there through for coupling with the traditional intonation adjustment bolt 102. This allows for the string bender 114 to be moved forward and backward relative to the guitar body 103.

The upwardly extending wall 130*c* further includes a mounting body 131 coupled to the top of it which extends forward and back of the upwardly extending wall 103*c*. The mounting body 131 is generally parallel to the first arm 130*a* and second arm 130*b*. A front portion 137 of the mounting body 131 provides an overhead bridge 118. The overhead bridge 118 has a bridging component 120 and an aperture 122. A rear portion 133 of the mounting body 131 is provided to facilitate the coupling of a bending assembly 135.

A U-shaped spring 139, having a first leg 141 integrally connected to a second leg 143 is positioned horizontally on the rear portion 133 of the mounting body 131. Each of the rear portion 133 and the first leg 141 is provided with holes which are aligned axially with each other when the U-shaped spring 139 is properly positioned. An attachment bolt 160 is used to couple these two components on the rear portion 133 of the mounting body 131. A handle block 145 and the second leg 143 of the spring 139 are also equipped with holes which are axially aligned with each other. The handle block 145 is coupled to the second leg 143 of the U-shaped spring 139 using a screw 147 (shown in FIG. 8) which passes through and engages threads in handle block 145 and the second leg 143.

The handle block 145 has a rear edge 151 and a front edge 161. In close proximity to the rear edge 151 of the handle block 145, a hole 153 is provided to facilitate the attachment of the handle 124 to the handle block 145. The handle 124 comprises a base portion 155 that has a hole 157 that is axially aligned with the hole 153 of the handle block 145. For easy assembly the base portion 155 is also provided with a lip 169 on the bottom surface thereof. The lip abuts the rear edge 151 of the handle block 145 to ensure easy positioning and aligning of the holes 157 and 153. A screw 126 is passed through the hole 157 in the base portion 155 of the handle 124 and is engaged with threads on the inside of hole 153 in the handle block 145. This couples the handle 124 to the handle block 145. By providing this coupling between the handle 124 and the handle block 145 the handle 124 is essentially coupled to the spring 139 and the mounting body 131. Extending forwardly from the base portion of the handle 124 is a forward lever 159. Extending rearwardly from the base portion of the handle 124 is a rear lever 167.

The front edge 161 of handle block 145 includes an upwardly extending wall 163. A hole 165 is provided through this wall. In use, a guitar string would be fed through hole 165 until the anchor 171 abuts the rear face 173 of the upwardly extending wall 163. The guitar string is then passed through the hole 122 in the front portion 137 of the mounting body 131. The string 138 then passes below the overhead bridge 120 and continues along the guitar and is attached to a tuning peg 121 (shown in FIG. 121) at the far end of the guitar. At this point the string would be tensioned until the tune of the string was satisfactory to the artist. During this process the position of the handle block 145 may change slightly as spring 139 is deformed under the tension of the spring. The position of the handle block 145 once the string has been tuned would define the neutral position of the spring 139.

The string bender 114 is activated by the upward or downward movement of the forward lever 159 or rear lever 167. If the forward lever 159 is pushed down, the rear edge 151 of the handle block 145 is raised and the second leg 143 of the U-shaped spring 139 is also raised. This causes the forward dip of the upwardly directed wall 163 and the forward dip of guitar string anchor 171. In performing this movement the guitar string tension is decreased, causing the pitch of the string to decrease as well. If the forward handle 159 is raised or the rear lever 167 is depressed, the rear edge 151 of handle block 145 is moved downward and the second leg 143 of the U-shaped spring 139 is also moved downwards towards the first leg 141. This causes the upwardly directed wall 163 of the handle block 145 to be raised moving the guitar string anchor 171 upwardly and rearwardly. This increases the tension on the guitar string 138 and thus raises the pitch of the string.

Screws 142*a* and 142*b* are provided to engage with holes 131*a* and 131*b* in arms 130*a* and 130*b* respectively. The bottom ends of the screws 142*a* and 142*b* abut the top surface of the bridge plate 100. By adjusting the position of the screws 142*a* and 142*b*, the guitar string height can be adjusted.

Figure 11:
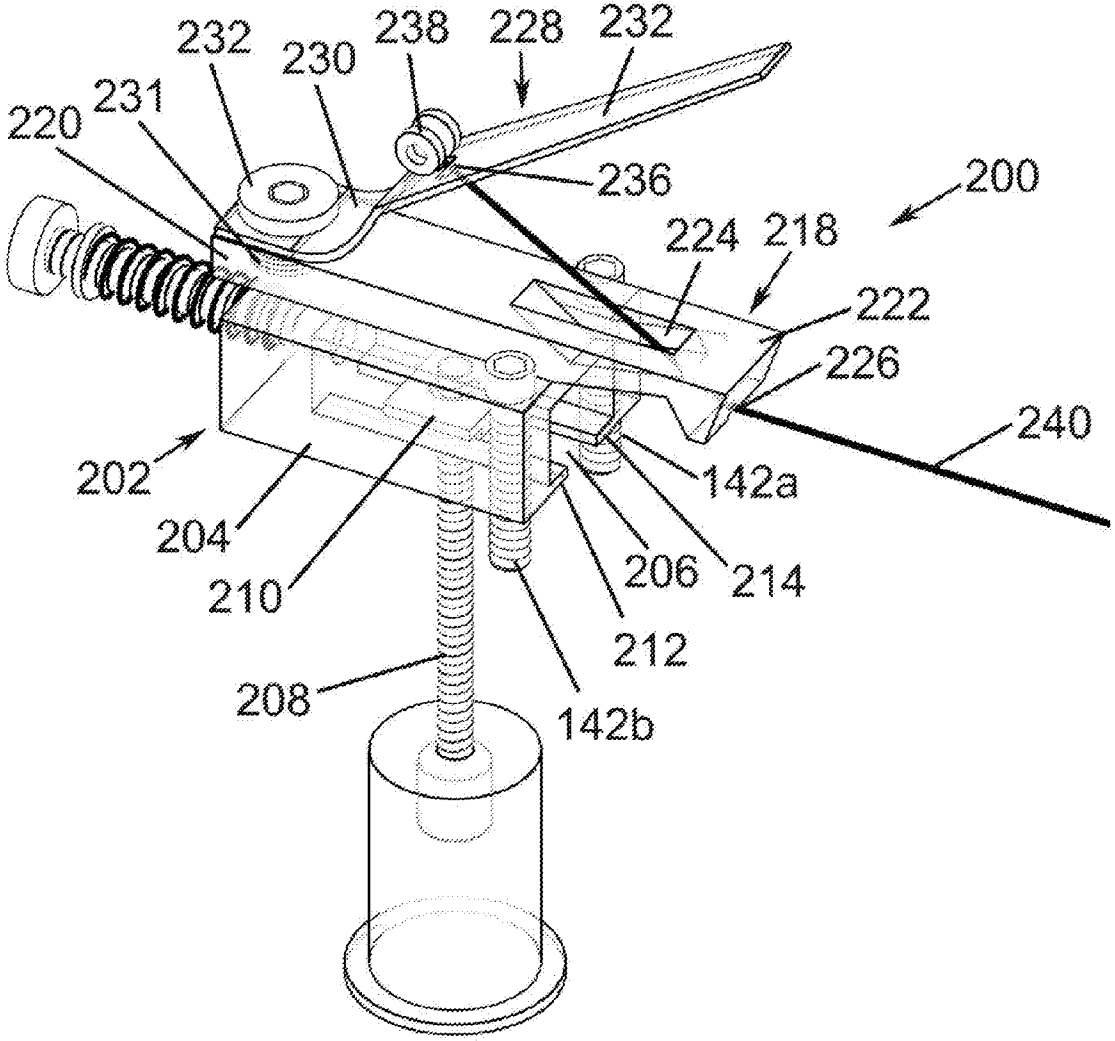
FIG. 11 shows a perspective view of a third embodiment of the guitar string bender.
Figure 12:
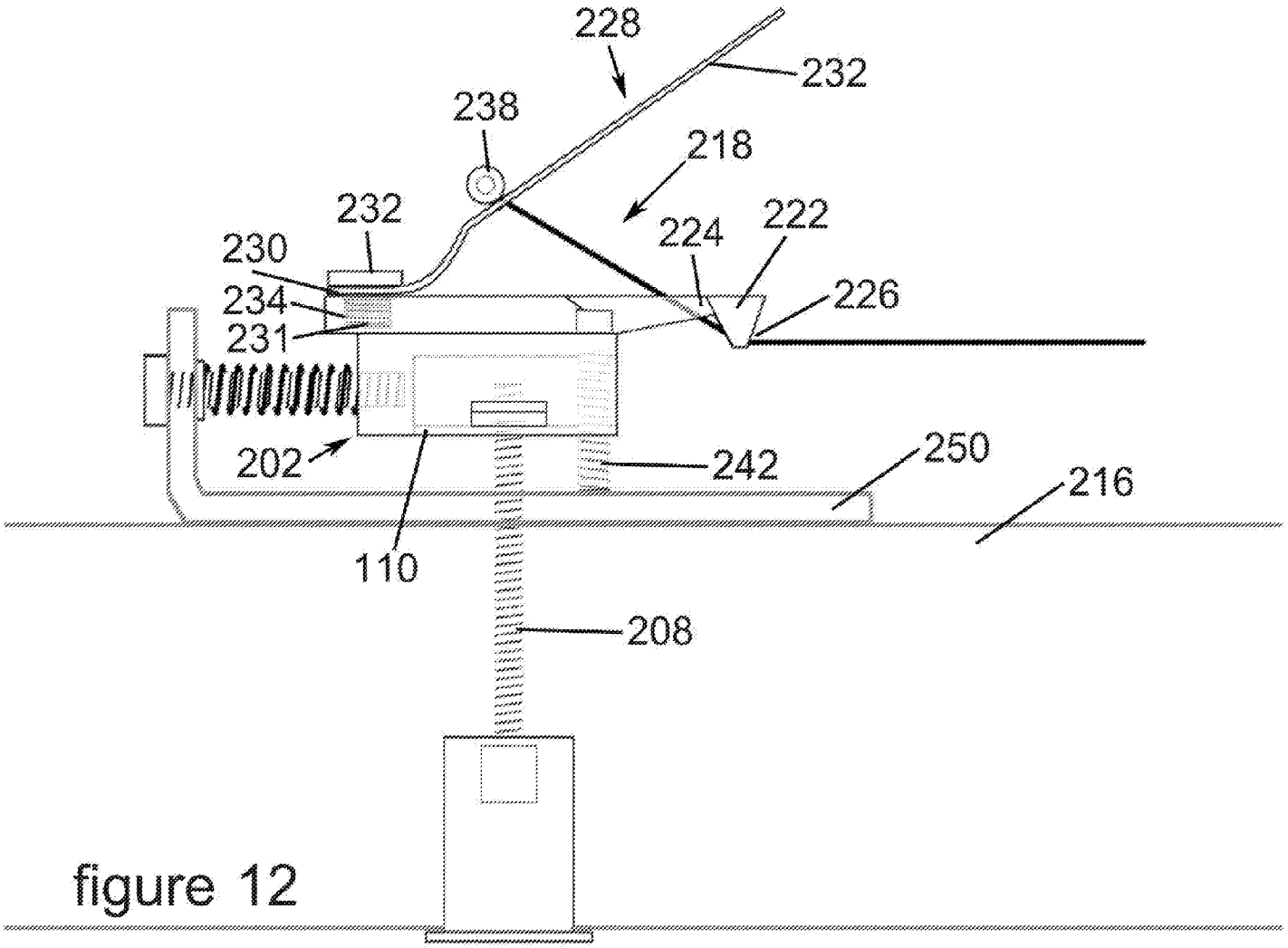
FIG. 12 shows a side elevation view of the third embodiment of the guitar string bender mounted on a guitar body having a bridge plate assembly.

An alternative embodiment of a string bender 200 for mounting on a guitar with a bridge plate apparatus is shown in FIGS. 11 and 12. The mounting block 202 has a base portion 204 which is equipped with a T-shaped channel 206 through the middle thereof. As shown in FIG. 1, a mounting screw 208 is fed up through the back of the guitar and is provided with a T-shaped bolt 210 for engagement with the T-shaped channel 206.

The mounting block 202 can receive the bolt 210 of the mounting screw 208 within its shaped channel 206. The walls 212 and 214 of the T-shaped channel 206 can accommodate the head of the mounting screw 208 while the upper portion of the T-shaped channel 206 can accommodate any excess screw length and allow for the adjustment of the height of the mounting block 202 from the guitar body 216.

Above the mounting block and attached integrally thereto is a handle mounting body 218. The rear portion 220 of the handle mounting portion 218 is equipped with a hole to receive a screw. The forward portion 222 of the handle body 218 is equipped with an aperture 224 and an overhead bridge 226. A handle member 228, having a base portion 230 and a lever 232 is coupled to the rear portion 220 of the handle mounting block 218 via screw 231 which passes through a hole in the base portion 230 of the handle 228 and engages threads in a hole 234 of the handle mounting block 218.

A guitar string is passed through another hole 236 in the lever 232 until the anchor 238 abuts the lever 232. The guitar string is then passed through the aperture 224 in the forward portion 222 of the handle block 218 and under the overhead bridge 226. The guitar string is then fixed at the far end of the guitar to a tuning peg 121. As with the previous design, the artist can then adjust the length of the guitar string using the tuning peg 121 to achieve a desired neutral pitch.

The string bender 200 is activated by the upward or downward movement of the lever 232. The downward movement of the lever 232 moves the string anchor 238 towards the tuning peg 121, which decreases the tension of the string 240 and thus the pitch of string 240 is lowered.

In contrast, the upward movement of the lever 232 causes the string anchor 238 of the string 240 to be moved away from the tuning pegs and thus the tension of string 240 is increased. This raises the pitch of string 240.

Allen screws 242*a* and 242*b* are provided through and engaged with threaded holes in the walls 212 and 214 of the T-shaped channel 206. One end of the screws abuts the bridge plate 240. By adjusting the position of the screws 242*a* and 242*b*, the guitar string height can be adjusted.

Figure 18:
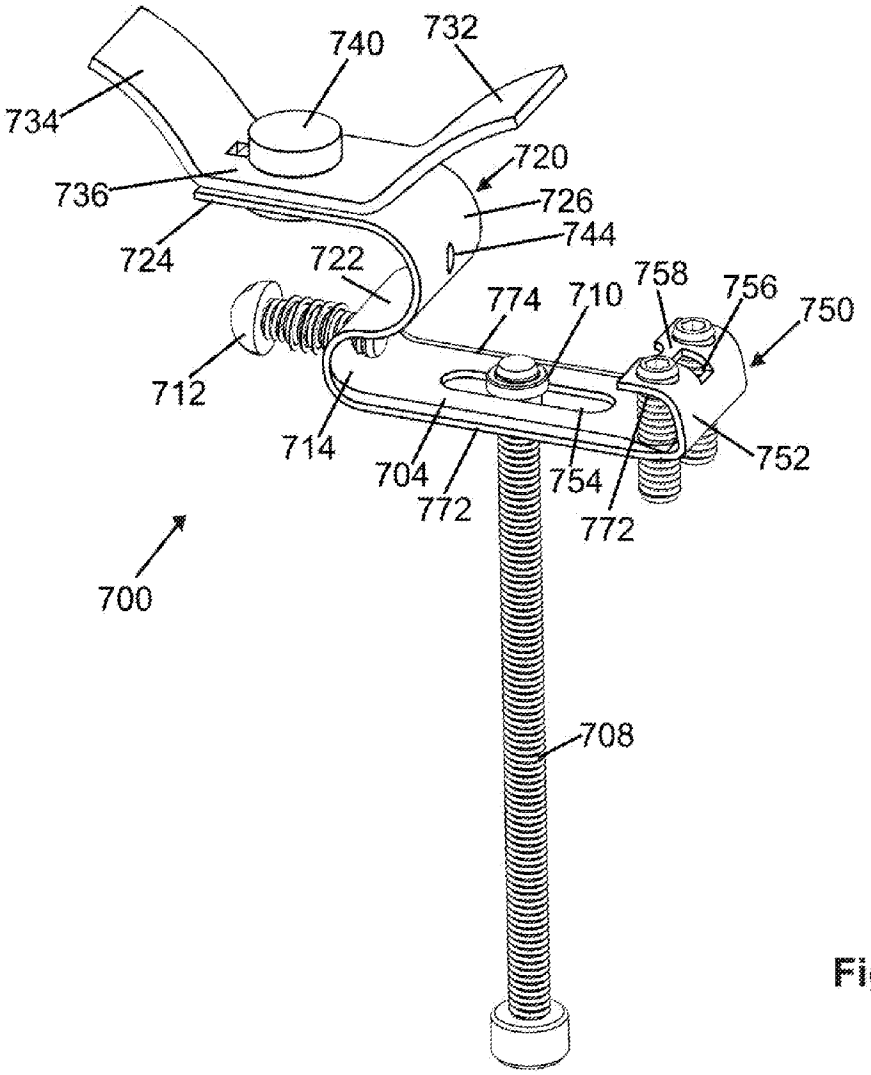
FIG. 18 depicts a perspective view of an alternative embodiment of a guitar string bender to be mounted to a guitar with a bridge plate.
Figure 19:
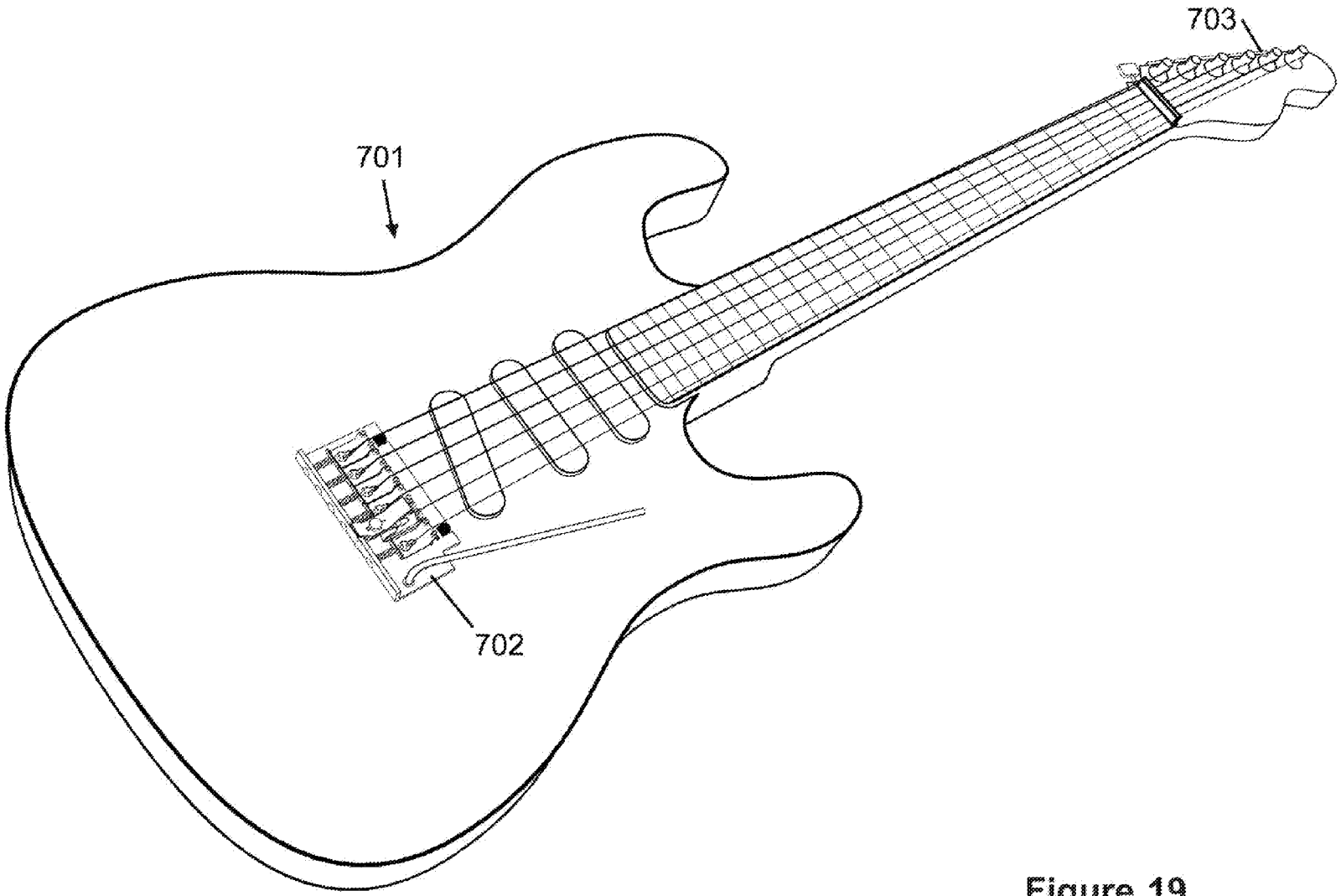
FIG. 19 depicts the alternative embodiment of the guitar string bender to be mounted on a guitar having a bridge plate.

An alternative design for a guitar string bender for mounting to a bridge plate is shown in FIG. 18. The guitar string bender 700 is mounted on the bridge plate 702, as shown on a guitar 701 in FIG. 19, and mounted to the bridge plate in isolation in FIG. 20. The string bender 700 comprises a base plate 704 having an elongated slot 706 sized to receive a mounting screw 708 which is fed through from the back of the guitar 701 body as described in the alternative design. The mounting screw 708 is fitted with a mounting head 710 which has a diameter bigger than the width of the elongated slot 706 to couple the base plate 704 to the guitar 701. The base plate 704 extends upwardly at one end thereof to receive the intonation screw 712. This upward portion 714 can be either straight or curved and contains a hole 716 (shown in FIG. 21) for receipt of the intonation screw 712. The intonation screw 712 is fed through the vertically directed wall 718 of the bridge plate 702 before engaging hole 716 of the string bender 700. It is used to adjust the position of the string bender 704 forward and back along the bridge plate 702. Any other suitable coupling mechanism can be used.

The upward portion 714 is connected to a u-shaped spring 720. In this preferred design the u-shaped spring 720 is formed from the same piece of metal of the base plate 704 and upward portion 714. The u-shaped spring 720 has a first leg 722 and a second leg 724 connected by the curved portion 726. The first leg 722 is connected to the upward portion 714.

Figure 21:
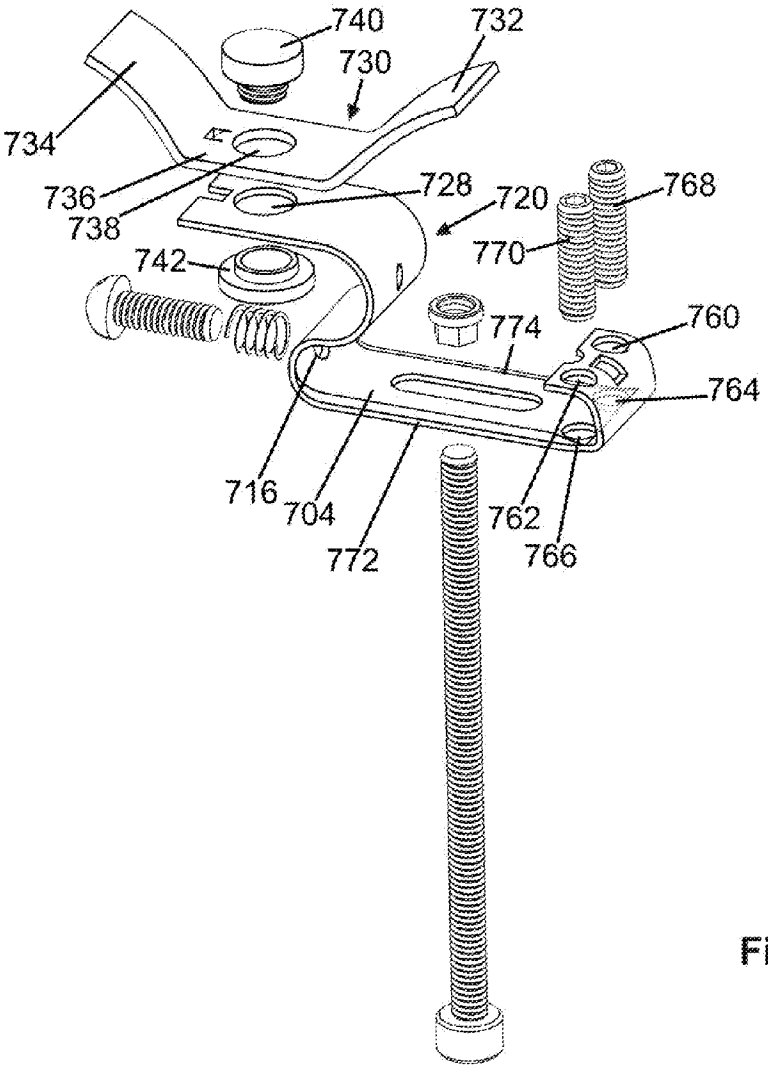
FIG. 21 depicts an exploded view of the alternative embodiment of the guitar string bender for mounting to the bridge plate of a guitar.

The second leg 724 is equipped with a hole 728, as shown in FIG. 21, to facilitate the attachment of an activation handle 730. The activation handle 730 has a forward lever 732 and a rearward lever 734. The forward lever 732 and rearward lever 734 are joined by a mounting portion 736. The mounting portion 736 contains a hole 738 which is designed to be of approximately the same size and generally aligned with hole 728 of the second leg 724 of the u-shaped spring 720. A bolt 740 is fed through the holes 728 and 738 in the second leg 724 and mounting portion 736 respectively. A nut 742 is used to complete the coupling of the activation handle 730 to the u-shaped spring 720. Any suitable mechanism can be used to couple the activation handle 730 to the u-shaped spring 720.

Although the embodiment shown in the drawings illustrates that the activation handle 730 is removable from the u-shaped spring 720, it is possible to integrally form an activation handle 730 with the u-shaped spring. The removable nature of the activation handle 730 in the preferred embodiment allows for the optional coupling of different styles of activation handles to the u-shaped spring. Various styles of activation levers could include both a forward activation lever and a rearward activation lever, a forward activation lever alone or a rearward activation lever alone. Alternatively it is possible to have activation levers which are directed across the body of the guitar.

Figure 22:
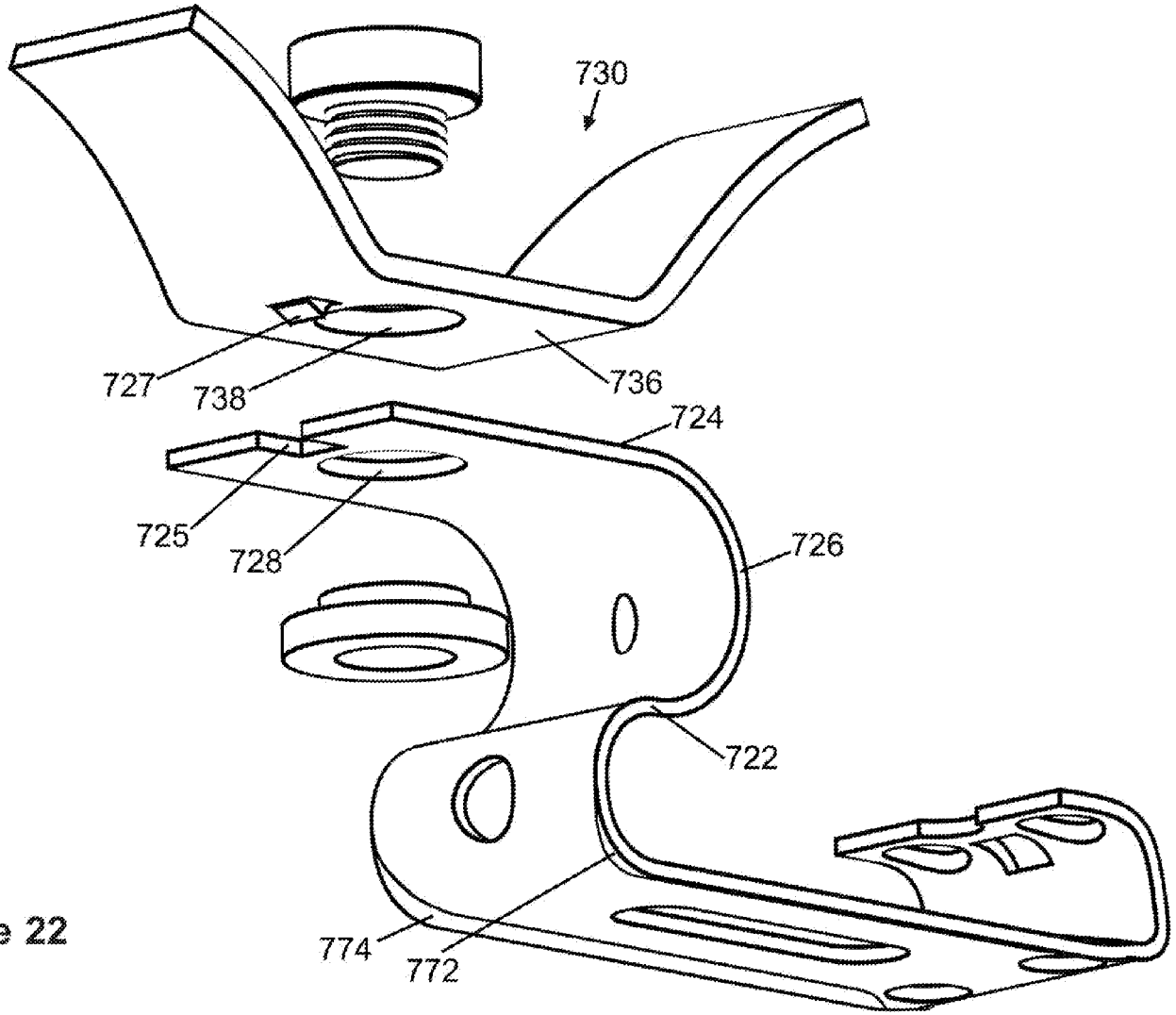
FIG. 22 depicts the alternative embodiment for a guitar string bender to be mounted to a guitar having a bridge plate showing the assembly of the u-shaped spring device to the activation lever.

As shown in FIG. 22, the second leg 724 of the u-shaped spring includes a cutout 725 at the end thereof. This cutout 725 is sized to receive protrusion 727 on the underside of mounting portion 736 of activation handle 730. The engagement of the protrusion 727 within the cutout 725 prevents twisting of the activation handle 730 relative to the second leg 724 of the u-shaped spring. Although the cut out in the preferred embodiment is located along one edge of the second leg of the u-shaped spring, it can alternatively take the form of a hole or indent within the body of the second leg.

Figure 23:
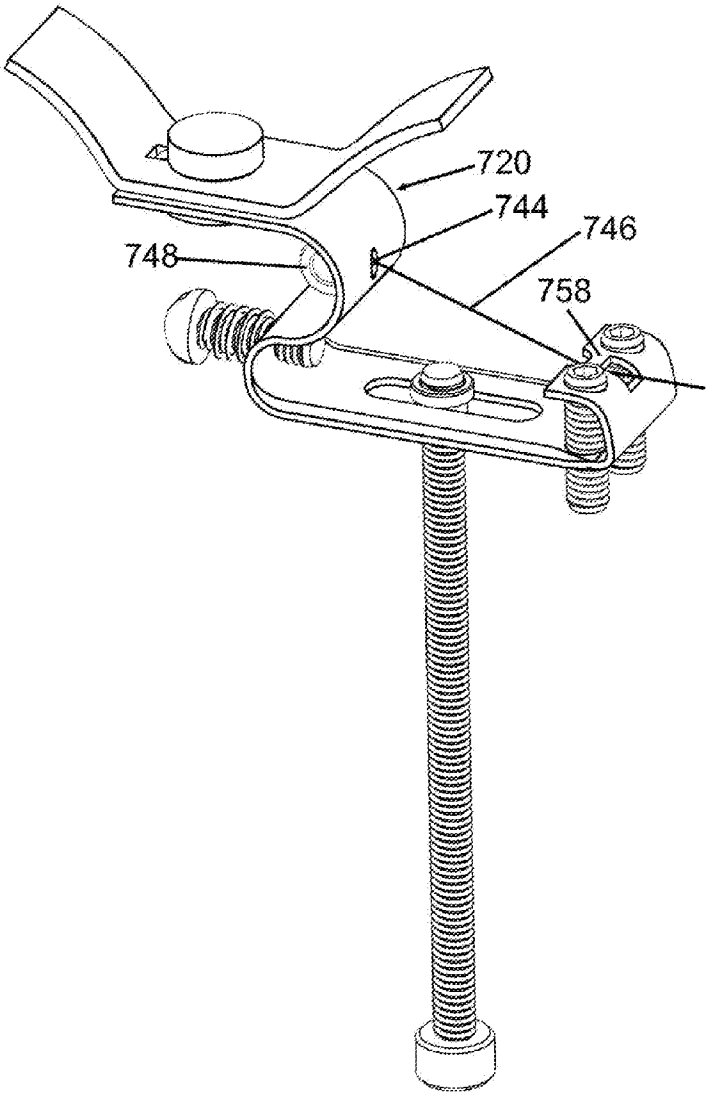
FIG. 23 shows the alternative embodiment of a guitar string bender to be mounted on a guitar having a bridge plate with the guitar string linkage therewith.

The curved portion 726 of the u-shaped spring 720 is equipped with a hole 744 through which a guitar string 746 is passed. This is shown in FIG. 23. The guitar string 746 is wound about an anchor 748 at one end thereof. The second end of the guitar string 746 is attached to a tuning peg 703 (shown in FIG. 19) and tightened until a desired intonation is reached. At this point the anchor 748 is positioned to contact of the inside surface with the u-shaped spring 720.

Figure 20:
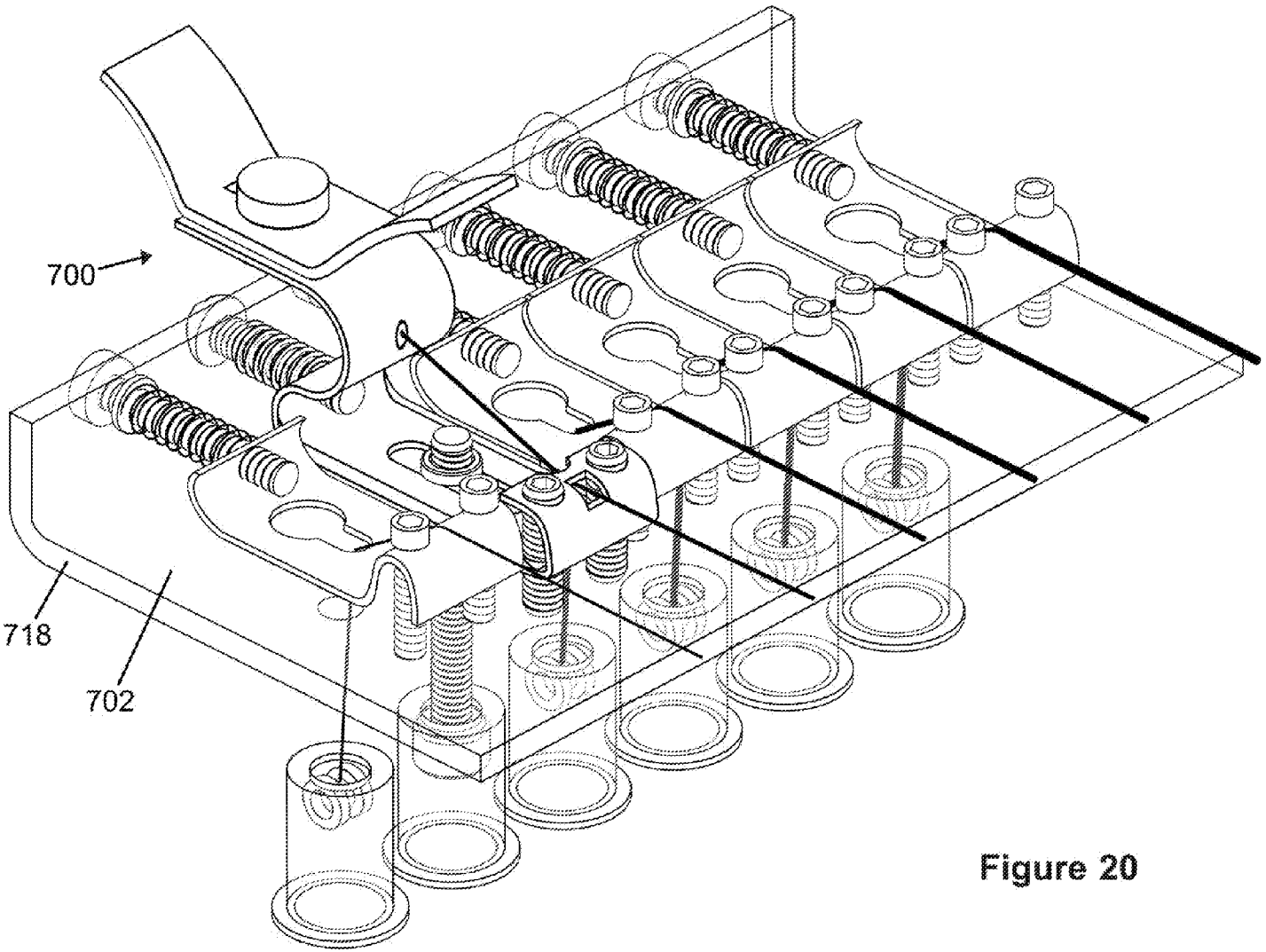
FIG. 20 depicts the alternative embodiment of the guitar string bender mounted on the bridge plate of a guitar.

Returning our attention to FIG. 18, an overhead bridge 750 is connected to the base plate 704 at an end opposite the upward portion 714. This is overhead bridge 750 first extends upwardly from the base plate via wall 752. An inwardly extending portion 754 extends inwardly from the top of the wall 752 towards the u-shaped spring. The overhead bridge 750 is equipped with a hole 756 through which the guitar string 746 is passed. This is shown in FIGS. 20 and 23. The string, when under tension, presses up against a central portion 758 of the inwardly extending portion 754 before passing through the hole 756. This controls the height of the guitar string relative to the string bender. The overhead bridge 750 further contains two circular holes 760 and 762 (shown in FIG. 21). These holes are aligned with two holes 764 and 766 respectively in the base plate 704. Height adjustment screws 768 and 770 engage the respective pairs of holes and extend therethrough. The height adjustment screws 768 and 770 extend beyond the bottom of the base plate 704. The bottom of the height adjustment screws press against the bridge plate 702 and allow for vertical adjustment of the overhead bridge 750, and thus the string 746, relative to the bridge plate 702.

The base plate 704 includes two downwardly turned flanges 772 and 774 along the longitudinal edges of the base plate 704. In a preferred embodiment, these downwardly extending flanges provide stiffness to the base plate 704.

The string bender 700 is activated by the upward or downward movement of the forward lever 732 or rearward lever 734. If the forward lever 732 is depressed or the rearward lever 734 is pulled upward, the second leg 724 of the u-shaped spring is raised which causes the forward dip of the u-shaped portion 726 of the u-shaped spring and thus the forward dip of the guitar string barrel 748. In performing this movement, the guitar string tension is decreased causing the pitch of the string to decrease as well.

If the forward lever 732 is raised, or the rearward lever 734 is depressed, the second leg 724 of the u-shaped spring 720 is also moved downwards towards the bridge plate 702. This causes the u-shaped portion 736 of the u-shaped spring 720 to move upward and rearwardly. This increases the tension on the guitar string 746 and thus, increases the pitch of the string.

During assembly of the guitar string bender 700 to the guitar, a user would first feed the intonation screw 712 through the bridge plate 702 and through the upwardly directed wall 714 of the guitar string bender. This allows the user to set the distance of the guitar string bender 700 from the upwardly extending wall 718 on the bridge plate 702. Next, the user would adjust the height adjustment screws 768 and 770 to determine the preferred height of the guitar string 746. Finally, the mounting screw 708 would be fed up through the back of the guitar and the head of the screw 710 would be tightened. This ensures that the guitar string bender is supported by the vertical adjustment screws and the intonation screw while preventing vertical movement by tightening the head of the mounting screw.

This particular design has several advantages in that in can be stamped and bent out of a single piece of metal. Such a process makes the manufacturing costs significantly reduced when compared to the more complex structure shown in the previous embodiment.

As can be appreciated, the string bender design uses a spring component to maintain a neutral string position and allows flexibility to move the spring in two directions. This way the string can be adjusted upward in pitch and downward in pitch. The amount of the pitch can be varied and can change based on the spring material, spring size and other considerations, however, in a preferred embodiment it is possible to raise or lower the pitch of the string by 3 and 5 semitones respectively.

Figure 13:
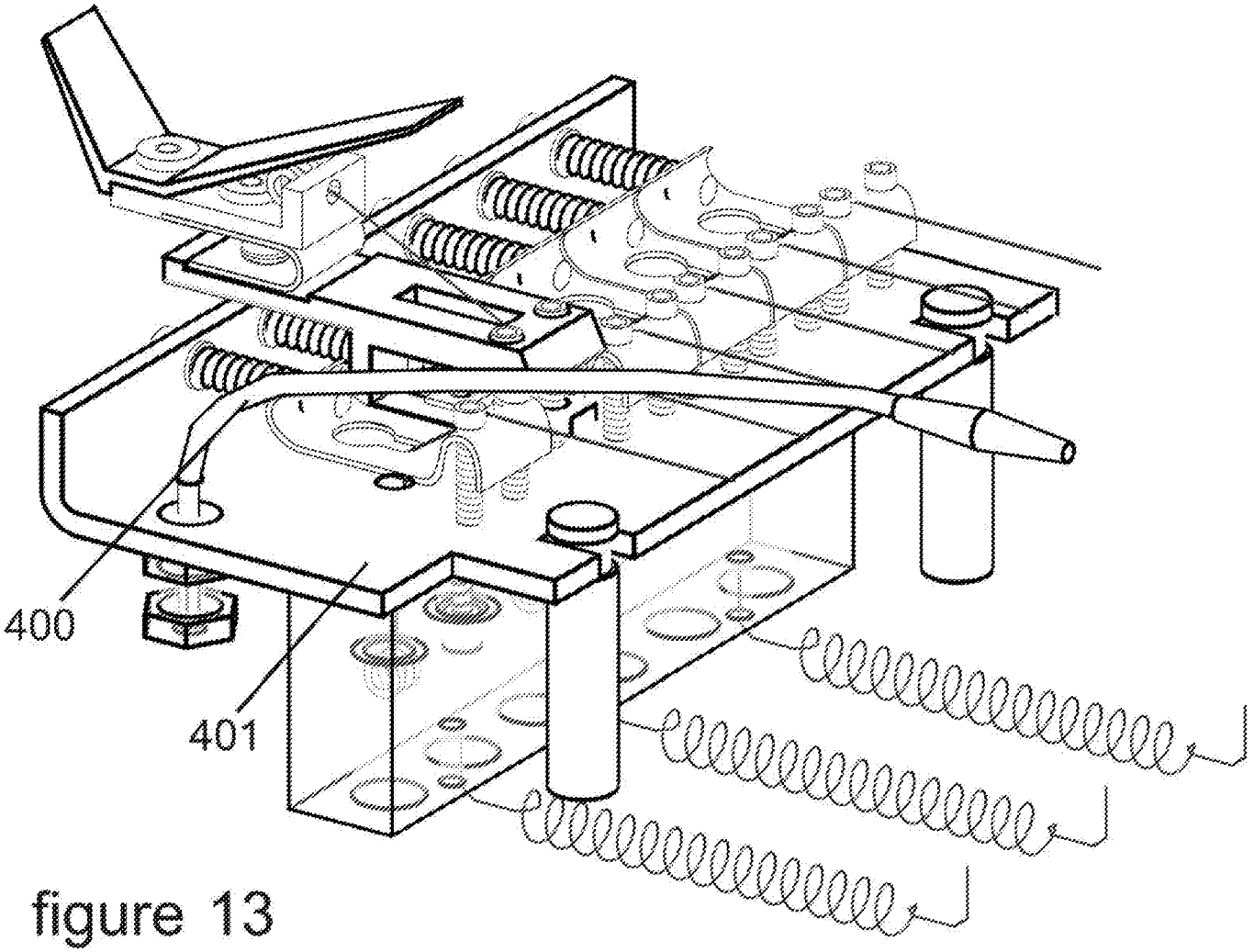
FIG. 13 shows a bridge plate assembly having the second embodiment of the guitar string bender mounted thereto wherein the plate assembly also includes a vibrato arm.

The string bender does not interfere with the mechanisms of a potential vibrato arm 400 already mounted on a bridge plate 401 as shown in FIG. 13.

Advantageously, the string bender uses existing structures of the guitar for its mounting means and requires no additional damage to the guitar. The string bender is simple in design and is small enough that each string could have a string bender attached thereto. This would maximize the creative opportunities for musicians.

Although the preferred embodiment is a string bender to be mounted to a guitar, it could be mounted to other stringed instruments including but not limited to bass guitars, electric or acoustic guitars, banjos or lap steel guitars.

Although various preferred embodiments of the present invention have been described herein in detail, it would be appreciated by those skilled in the art that that variations may be made thereto without departing from the appended claims.

I claim:

1. A string bender for use with a stringed instrument comprising a mounting arrangement to couple the string bender to the stringed instrument;

a spring device and an activation lever; and an anchoring arrangement to secure an anchor portion of an instrument string having a string portion and an anchor portion; said anchoring arrangement cooperating with said spring device such that when the instrument string is tensioned to achieve a desired neutral pitch, the spring device is in a neutral position;

said spring device is deformable such that by moving the activation lever in a first direction, the spring device is deformed from the neutral position in a first direction and the anchor portion of the string is moved to create increased tension of said instrument string, which raises the pitch produced by said instrument string and by moving the activation lever in a second direction, the spring device is deformed from the neutral position in a second direction and the anchor portion of the instrument string is moved to decrease the tension on the string, lowering the pitch produced by the instrument string;

and wherein said anchoring arrangement is a string aperture sized to allow the string portion of said instrument string to pass through while preventing the passage of the anchor portion to secure the instrument string to said string bender.

2. A string bender as claimed in claim 1 wherein the string bender is adapted to be coupled to a stringed instrument having a tailpiece; and said mounting arrangement includes a mounting plate having a first face adjacent a first surface of the tailpiece; the mounting plate further includes a second face adjacent the spring device; and the mounting arrangement is adapted to facilitate coupling of the tailpiece, mounting plate and spring device to couple the spring device to the stringed instrument.

3. A string bender as claimed in claim 2 wherein the mounting plate includes a hole and the spring device includes a hole; the hole in the mounting plate aligns with a string channel in the tailpiece of the stringed instrument and the hole in the spring device; and the mounting arrangement is adapted to facilitate coupling between said string channel, said hole in said mounting plate and said hole in said spring device to couple said spring bender to said stringed instrument.

4. A string bender as claimed in claim 3 wherein said spring device is U-shaped having a first leg and a second leg; and said hole in said spring device is located in said first leg of said U-shaped spring device.

5. A string bender as claimed in claim 4 wherein said hole in said mounting plate is elongated to allow for coupling of the string bender to various tailpiece designs.

6. A string bender as claimed in claim 5 wherein said mounting plate includes flanged sides which engage a first and second edge of the spring device to prevent twisting of the string bender relative to the tailpiece.

7. A string bender a claimed in claim 6 wherein said spring device includes an elongated second leg for attachment of the activation lever to the spring device.

8. A string bender as claimed in claim 7 wherein said elongated second leg includes a cutout to engage a protrusion on the underside of the activation lever to prevent twisting of the activation lever relative to the spring device.

9. A string bender as claimed in claim 8 wherein said string aperture is provided in the second leg of said spring device.

10. A string bender as claimed in claim 9 wherein the first and second leg of the spring device include at least 2 flanged edges.

11. A string bender as claimed in claim 1 wherein the mounting arrangement is adapted to be coupled to a stringed instrument having a bridge plate assembly and a channel extending through the stringed instrument body; and wherein said mounting arrangement couples a mounting plate of the string bender to the stringed instrument; said mounting plate having a first end and a second end; said first end being coupled to a spring device and said second end being coupled to a bridge device.

12. A string bender as claimed in claim 11 wherein said bridge device has an opening for the string to pass through and said anchoring arrangement is positioned above and rearwardly of said opening.

13. A string bender as claimed in claim 12 wherein said spring device, said mounting plate and said bridge devices are monolithically formed.

14. A string bender as claimed in claim 13 wherein the spring device is generally u-shaped having a first leg and a second leg and wherein said second leg is adapted to receive the activation lever.

15. A string bender as claimed in claim 14 wherein said second leg includes a cutout to engage a protrusion on the underside of the activation lever to prevent twisting of the activation lever relative to the spring device.

16. A string bender as claimed in claim 15 wherein the activation lever is monolithically formed with said spring device.

17. A string bender as claimed in claim 16 wherein said mounting plate includes at least 2 flanged edges.

18. A string bender as claimed in claim 17 wherein said mounting plate includes a hole to facilitated coupling of said mounting plate with said mounting arrangement.

19. A string bender as claimed in claim 18 wherein said hole in said mounting plate is elongated to provide forward and back adjustment of the string bender relative to the bridge plate.

20. A string bender as claimed in claim 19 wherein said mounting plate includes a vertical height adjustment assembly to adjust the height of the bride device from the bridge plate.

* * * * *